US008280091B2

(12) United States Patent
Voishvillo

(10) Patent No.: US 8,280,091 B2
(45) Date of Patent: Oct. 2, 2012

(54) DUAL COMPRESSION DRIVERS AND PHASING PLUGS FOR COMPRESSION DRIVERS

(75) Inventor: Alexander Voishvillo, Simi Valley, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 184 days.

(21) Appl. No.: 12/895,606

(22) Filed: Sep. 30, 2010

(65) Prior Publication Data

US 2011/0085692 A1 Apr. 14, 2011

Related U.S. Application Data

(63) Continuation-in-part of application No. 12/137,215, filed on Jun. 11, 2008, now Pat. No. 8,077,897.

(51) Int. Cl.

| | |
|---|---|
| ***H04R 1/00*** | (2006.01) |
| ***H04R 1/20*** | (2006.01) |
| ***H04R 9/06*** | (2006.01) |
| ***H04R 11/02*** | (2006.01) |

(52) U.S. Cl. ..... 381/343; 381/340; 381/398

(58) Field of Classification Search ..... 381/337–343, 381/398, 423, 430; 181/152, 159, 177–195
See application file for complete search history.

(56) References Cited

U.S. PATENT DOCUMENTS

| | | | | |
|---|---|---|---|---|
| 4,325,456 | A * | 4/1982 | Ureda | 181/159 |
| 4,525,604 | A * | 6/1985 | Frye | 381/343 |
| 5,878,148 | A | 3/1999 | Alexandrov | |
| 5,983,191 | A | 11/1999 | Ha et al. | |
| 6,064,745 | A * | 5/2000 | Avera | 381/343 |
| 6,205,228 | B1 * | 3/2001 | Czerwinski et al. | 381/340 |
| 6,320,970 | B1 * | 11/2001 | Czerwinski et al. | 381/343 |

FOREIGN PATENT DOCUMENTS

| | | | |
|---|---|---|---|
| DE | 4141843 | A1 | 6/1993 |
| DE | 19848491 | A1 | 4/2000 |
| EP | 1005252 | A2 | 5/2000 |

* cited by examiner

*Primary Examiner* — Tuan Nguyen
(74) *Attorney, Agent, or Firm* — The Eclipse Group LLP

(57) ABSTRACT

A phasing plug includes a base portion including an input side, an output side, a plurality of entrances on the input side, a plurality of exits on the output side arranged about a central axis, and a plurality of channels fluidly interconnecting the entrances with the respective exits. Each corresponding entrance, channel and exit establish an acoustical path from the input side to the output side that is non-radial relative to the central axis. Two phasing plugs may be provided in a dual compression driver.

55 Claims, 28 Drawing Sheets

DUAL COMPRESSION DRIVERS AND PHASING PLUGS FOR COMPRESSION DRIVERS

CROSS-REFERENCE TO RELATED APPLICATIONS

This application is a continuation-in-part of U.S. application Ser. No. 12/137,215, filed on Jun. 11, 2008, titled PHASING PLUG, which application is incorporated by reference in this application in its entirety.

BACKGROUND OF THE INVENTION

1. Field of the Invention

This invention relates generally to electro-acoustical drivers and loudspeakers employing electro-acoustical drivers. More particularly, the invention relates to improved configurations for compression drivers and phasing plugs utilized in compression drivers.

2. Related Art

An electro-acoustical transducer or driver is utilized as a component in a loudspeaker system to convert electrical signals into acoustical signals. The driver includes mechanical, electromechanical, and magnetic elements to effect this conversion. For example, the electrical signals may be directed through a voice coil that is attached to a flexible diaphragm and positioned in an air gap. The voice coil is immersed in a radially oriented magnetic field provided by a permanent magnet and steel elements of a magnet assembly. Due to the Lorenz force affecting the conductor of current positioned in the permanent magnetic field, the alternating current corresponding to electrical signals conveying audio signals actuates the voice coil to reciprocate back and forth in the air gap and, correspondingly, move the diaphragm to which the coil is attached. The diaphragm may be suspended by one or more supporting elements (e.g., a surround, spider, or the like) such that at least a portion of the diaphragm is permitted to move. Accordingly, the reciprocating voice coil actuates the diaphragm to likewise reciprocate and, consequently, produce acoustic signals that propagate as sound waves through a suitable fluid medium such as air. Sound pressure differences in the fluid medium associated with these waves are interpreted by a listener as sound. The sound waves may be characterized by their instantaneous spectrum and level.

The driver at its output side may be coupled to an acoustic waveguide, which is a structure that encloses the volume of medium into which sound waves are first received from the driver. The waveguide may be designed to increase the efficiency of the driver and control the directivity of the propagating sound waves. The waveguide typically includes one open end coupled to the driver, and another open end or mouth downstream from the driver-side end. Sound waves produced by the driver propagate through the waveguide and are dispersed from the mouth to a listening area. The waveguide may be structured as a horn or other flared structure such that the interior defined by the waveguide expands or increases from the driver-side end to the mouth.

Electro-acoustical transducers or drivers may be characterized into two broad categories: direct-radiating types and compression types. A direct-radiating transducer produces sound waves and radiates these sound waves directly into open air (i.e., the environment ambient to the loudspeaker), whereas a compression driver first moves air in a radial direction in a high-pressure region, or compression chamber, and then produces sound waves that propagate in an axial direction to the typically much lower-pressure open-air environment. The compression chamber is open to a structure commonly referred as a phasing plug that works as a connector between the compression chamber and the horn. The area of the exit of the compression chamber (i.e., the entrance to the phasing plug) is smaller than the effective area of the diaphragm. This provides increased efficiency as compared to a direct-radiating loudspeaker. In a direct-radiating loudspeaker, the mechanical output impedance of the vibrating diaphragm is significantly higher than the loading impedance of the open air (the radiation impedance). This results in a mismatch between the "generator" (diaphragm) and the "load" (open air radiation impedance). In a compression driver, the loading impedance (entrance to the phasing plug) is significantly higher than the open air radiation impedance. This produces much better matching between the "generator" and the "load" and increases the efficiency of the compression driver as a transducer. Typically, it is considered ideal to attain 50% driver efficiency when the mechanical output impedance of the vibrating diaphragm is equal to the mechanical loading impedance of the phasing plug with the horn connected to it.

As noted, a compression driver utilizes a compression chamber on the output side of the diaphragm to generate relatively higher-pressure sound energy prior to radiating the sound waves from the loudspeaker. Typically, a phasing plug is interposed between the diaphragm and the waveguide or horn portion of the loudspeaker, and is spaced from the diaphragm by a small distance (typically a fraction of a millimeter). Accordingly, the compression chamber is bounded on one side by the diaphragm and on the other side by the phasing plug. The phasing plug is typically perforated in some fashion. That is, the phasing plug includes apertures (i.e., passages or channels) that extend between the compression chamber and the waveguide or horn portion of the loudspeaker to provide acoustic pathways from the compression chamber to the waveguide. The cross-sectional area of the apertures is small in comparison to the effective area of the diaphragm, thereby providing air compression and increased sound pressure in the compression chamber.

The compression driver, characterized by having a phasing plug and a compression chamber, may provide a number of advantages if properly designed. These advantages may include increasing the efficiency with which the mechanical energy associated with the moving diaphragm is converted into acoustic energy. Decreasing the parasitic compliance of air in the compression chamber prevents undesired attenuation of high-frequency acoustic signals. Properly positioning the apertures in the phasing plug and sizing the lengths of the associated passages may result in delivering sound energy in phase from all parts of the diaphragm, suppressing or canceling high-frequency standing waves in the compression chamber, and reducing or eliminating undesired interfering cancellations in the propagating sound waves. Particularly for high frequencies, compression drivers may be considered to be superior to direct-radiating drivers for generating high sound-pressure levels.

The diaphragm of a compression driver may have an annular shape and be coaxially disposed about central structures of the phasing plug. An annular diaphragm may have various configurations. As examples, the annular diaphragm may have a V-shaped cross-section (FIG. 27), an M-shaped cross-section (FIG. 28), a dual roll cross-section (FIG. 29), or various combinations of the foregoing as well as other shapes. Different shapes of annular diaphragms have their own advantages and drawbacks. As examples, the V-shaped diaphragm has the lowest resonance frequency (in comparison to other diaphragms having similar voice coils) but its flat suspension is the most nonlinear. The suspension of the V-shaped diaphragm has the shape of internal and external flat rings, which is the softest configuration but has limited displacement capability, i.e., the stiffness of the V-shaped diaphragm rapidly increases with displacement. In comparison to other diaphragms having comparable attributes (e.g., similar inside diameter, voice coil diameter, thickness of diaphragm, and material composition of diaphragms, the M-shaped diaphragm and the dual roll diaphragm have higher resonance frequency (stiffer suspensions) but their suspensions are significantly more linear because of their geometry. The application of an annular diaphragm of a particular shape depends on the requirements of the desired frequency range, the linearity of displacement, and the shape of the frequency response.

Annular diaphragms may be fabricated out of different materials. For example V-shaped diaphragms made of aluminum foil have been manufactured since the early 1950s for high-frequency compression drivers. More recently, compression drivers based on annular diaphragms are typically made of thermoformed polymer films. The capability of the driver to efficiently reproduce high frequency signals depends predominantly on the diaphragm's moving mass and on its high frequency breakups (i.e. partial resonances). At high frequency range the diaphragm does not vibrate as a solid shell, but rather its parts vibrate with different amplitudes and phases. At the resonances (breakups) the diaphragm's overall surface exhibits an increase of displacement and, velocity, and therefore the upper part of the frequency range is increased as well. Due to the high internal damping of polymer films the frequency response of plastic diaphragms is typically much smoother than that of the diaphragms made of aluminum or titanium. There are several factors that limit high frequency signal, including the moving mass of the diaphragm assembly and the volume of the compression chamber. The higher the moving mass, the lower is the high-frequency roll-off (the frequency where the response starts to decrease). The larger the volume of the compression chamber, the lower is the roll-off of the frequency response. Acoustical compliance of air in the compression chamber acts as a low-pass filter, and a larger height of the compression chamber causes a higher compliance of the "air spring", and correspondingly, attenuation of high-frequency signals.

Extension of high frequency response could be obtained by decreasing the moving mass of the diaphragm assembly. However, this would require a smaller diaphragm and a smaller voice coil, which implies a smaller power handling capability. Attempts have been made to avoid this problem by manifolding compression drivers to make them work to a single acoustical load. In one example, several drivers have been mounted to the input ends of a Y-shaped or double Y-shaped tube, with a horn mounted to the single output end of the tube. In another example, several drivers have been stacked into a linear array, with circuitry provided on the input side of each driver to customize the individual frequency and directivity responses of the drivers. In another example, multiple drivers have been symmetrically mounted on opposing sides of a single horn structure, with the higher-frequency drivers being located behind the lower-frequency drivers relative to the mouth of the single horn. In another example, two compression drivers are arranged such that their respective diaphragms axially oppose each other and are coaxial with a central sound output bore. Each driver includes rotationally symmetric radial slots, all of equal length, across their respective compression chambers. The radial slots lead to radial channels that in turn lead to the central sound output bore. The radial slots of the one driver are interleaved with the radial slots of the other driver. That is, the circumferential positions of the radial slots of the one driver alternate with the circumferential positions of the radial slots of the other driver. None of these past approaches is considered to provide the performance criteria currently sought for compression drivers. For instance, the use of equal-length radial slots is disadvantageous in that they may fail to suppress circumferential resonances in the compression chamber, which may degrade the desired frequency response.

Accordingly, there exists an ongoing need for improved designs for compression drivers so as to more fully attain their advantages such as high-frequency efficiency, while ameliorating their disadvantages such as detrimental acoustical nonlinear effects, irregularity of frequency response, and limited frequency range.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a dual phasing plug assembly for a compression driver includes a first phasing plug and a second phasing plug. The first phasing plug includes a first base portion. The first base portion includes a first input side, a first output side, a central bore coaxial with a central axis and extending from the first input side to the first output side, a plurality of first entrances on the first input side, a plurality of first exits communicating with the central bore on the first output side, and a plurality of first channels fluidly interconnecting the first entrances with the respective first exits. Each corresponding first entrance, first channel and first exit establish a first acoustical path that is non-radial relative to the central axis. The second phasing plug includes a second base portion. The second base portion includes a second input side, a second output side facing the first output side, a plurality of second entrances on the second input side, a plurality of second exits on the second output side, and a plurality of second channels fluidly interconnecting the second entrances with the respective second exits. Each corresponding second entrance, second channel and second exit establish a second acoustical path that is non-radial relative to the central axis. The second phasing plug further includes a hub portion extending along the central axis from the second output side through the central bore. The hub portion includes an outside surface having a diameter coaxial with the central axis. The first exits and the second exits communicate with an annular region between the central bore and the outside surface.

According to another implementation, a dual compression driver includes a first magnet assembly including an annular first air gap, a first voice coil assembly axially movable in the first air gap, a first diaphragm attached to the first voice coil assembly, a second magnet assembly including an annular second air gap, a second voice coil assembly axially movable in the second air gap, and a second diaphragm attached to the second voice coil assembly. The dual compression driver further includes a first phasing plug forming a first compression chamber with the first diaphragm, and a second phasing plug forming a second compression chamber with the second diaphragm. The first and second phasing plugs may be configured as summarized above.

According to another implementation, a phasing plug includes a base portion including an input side, an output side, a plurality of entrances on the input side, a plurality of exits on the output side arranged about a central axis, and a plurality of channels fluidly interconnecting the entrances with the respective exits. Each corresponding entrance, channel and exit establish an acoustical path from the input side to the output side that is non-radial relative to the central axis. The entrances lie along a plurality of lines collectively forming a polygon that includes greater than four vertices at which neighboring lines adjoin.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The description of examples of the invention below can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

According to certain implementations described by example below, a dual compression driver may be provided by positioning two drivers face-to-face in such a way that the drivers are loaded by the same acoustical load. The two drivers may be combined into a single unit that includes two motors, two diaphragms and two voice coils, but a single exit for sound output. The dual compression driver may include a dual phasing plug assembly configured in accordance with implementations described by example below. One or both phasing plugs may be configured in accordance with implementations also described by example below.

Figure 1A:
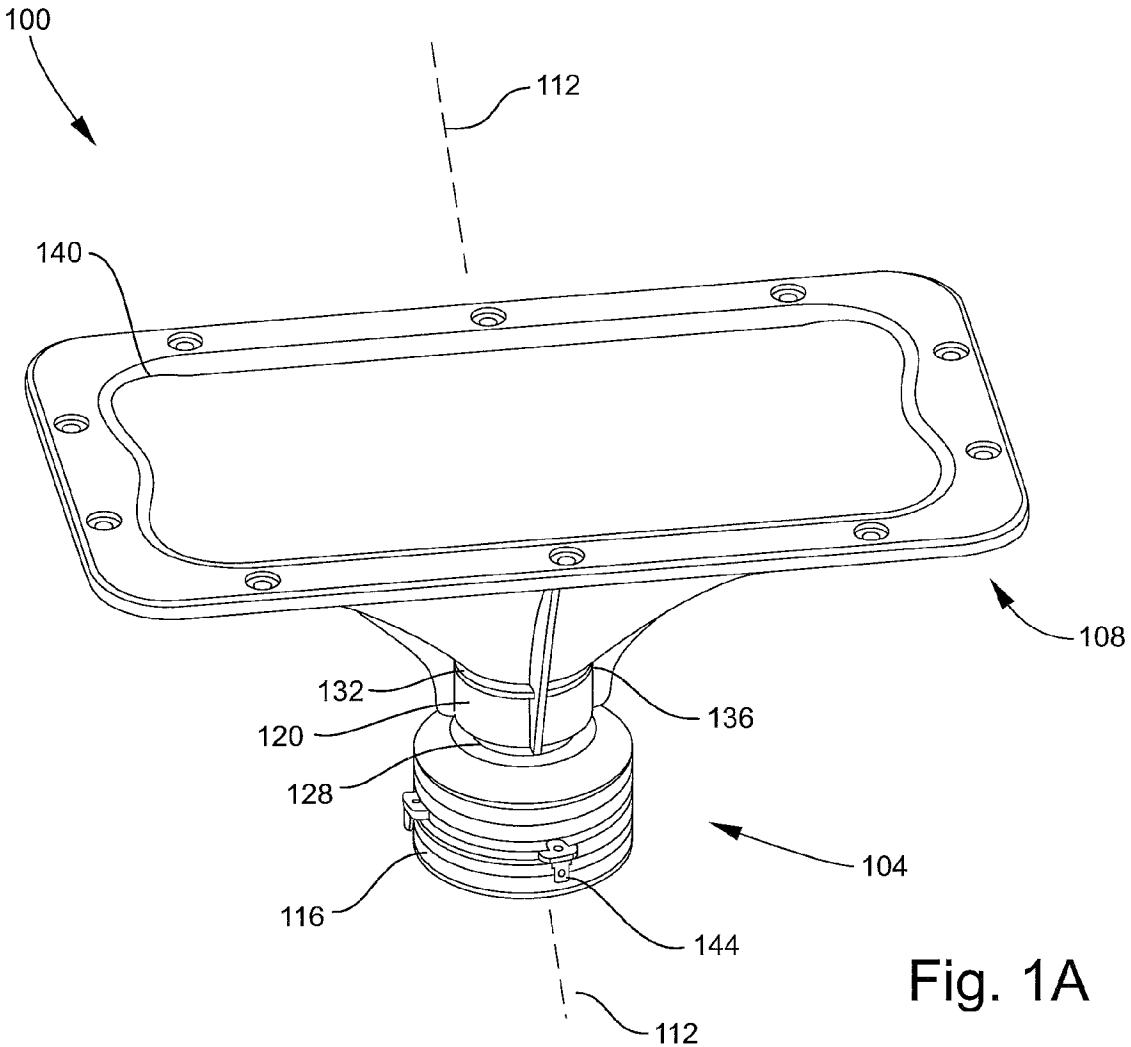
FIG. 1A is a perspective view of an example of a loudspeaker in which dual compression drivers as described below may be implemented.

FIG. 1A is a perspective view of an example of a loudspeaker 100 in which dual compression drivers as described below may be implemented. The loudspeaker 100 includes an electro-acoustical transducer section 104. In some implementations, the loudspeaker 100 may also include a waveguide or horn 108. The transducer section 104 and horn 108 are generally disposed about a longitudinal or central axis 112. The transducer section 104 may include a rear section 116 and a housing or adapter 120. The rear section 116 may be coupled to the housing 120 by any suitable means. The rear section 116 and housing 120 may enclose components for realizing a dual compression driver, an example of which is described below. The horn 108 may include a horn structure 124 such as one or more walls that enclose an interior 128 of the horn 108. As illustrated, the horn structure 124 may be flared or tapered outwardly from the central axis 112 to provide an expanding cross-sectional area through which sound waves propagate. The housing 120 generally includes a first or input end 128 and a second or output end 132. Likewise, the horn 108 generally includes a first or input end 136 and a second or output end commonly referred to as a mouth 140. The output end 132 of the housing 120 may be coupled to the input end 136 of the horn 108 by any suitable means. In the present example, the horn 108 is attached to the housing 120 or rear section 116 via a screw-on connection. Generally, the loudspeaker 100 receives an input of electrical signals at an appropriate connection such as contacts 144 provided by the transducer section 104 (such as may be located at the rear section 116) and converts the electrical signals into acoustic signals according to mechanisms briefly summarized above and readily appreciated by persons skilled in the art. The acoustic signals propagate through the interior of the housing 120 and horn 108 and exit the loudspeaker 100 at the mouth 140 of the horn 108.

Figure 1B:
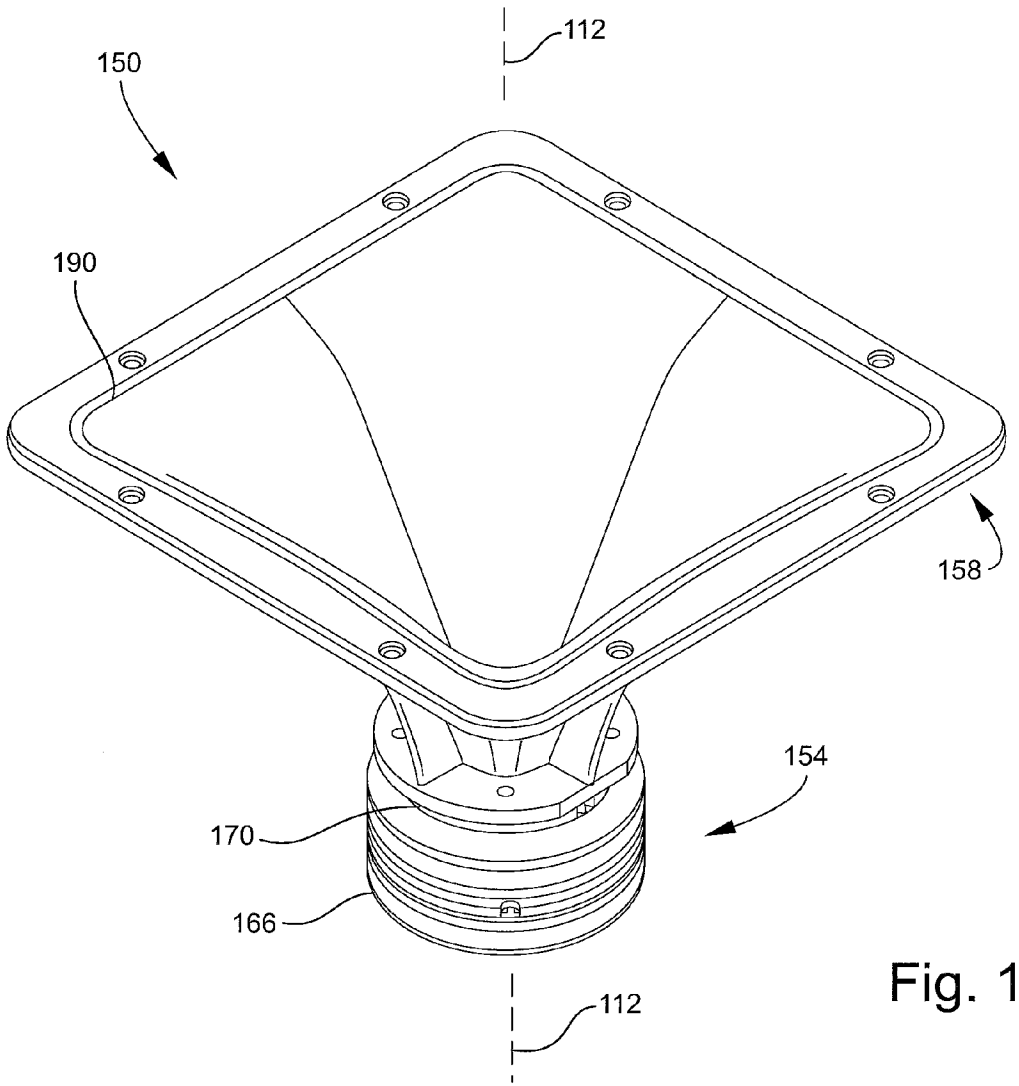
FIG. 1B is a perspective view of another example of a loudspeaker in which dual compression drivers as described below may be implemented.

FIG. 1B is a perspective view of another example of a loudspeaker 150 in which dual compression drivers as described below may be implemented. The loudspeaker 150 includes a transducer section 154 and a horn 158. The transducer section 154 may include a rear section 166 and a housing or adapter 170. In this example, the horn 158 includes a mouth 190 that is more square-shaped in comparison to the rectangular-shaped mouth of the example shown in FIG. 1A. Also in this example, the horn 158 is attached to the housing 170 or rear section 166 via a bolt-on connection as an alternative to a screw-on connection.

As a general matter, the loudspeaker 100 or 150 may be operated in any suitable listening environment such as, for example, the room of a home, a theater, or a large indoor or outdoor arena. Moreover, the loudspeaker 100 or 150 may be sized to process any desired range of the audio frequency band, such as the high-frequency range (generally 2 kHz-20 kHz) typically produced by tweeters, the midrange (generally 200 Hz-5 kHz) typically produced by midrange drivers, and the low-frequency range (generally 20 Hz-200 Hz) typically produced by woofers. As appreciated by persons skilled in the art, loudspeakers 100, 150 of the horn driver-type are typically utilized to process relatively high frequencies (i.e., midrange to high range), and compression drivers are typically more efficient at higher frequencies than non-compression driver configurations such as the direct-radiating type. However, the compression drivers described in the present disclosure are not limited to any particular frequency range.

FIGS. 2-29 illustrate examples of components that may be utilized in a loudspeaker such as illustrated in FIG. 1A or 1B. For convenience, the remainder of the description will refer primarily to the loudspeaker 100 associated with FIG. 1A. It will be understood, however, that the description applies equally to the loudspeaker 150 associated with FIG. 1B as a general matter, although some of the components shown in FIGS. 2-29 may be sized or otherwise configured more appropriately for the loudspeaker 100 while other components shown in FIGS. 2-29 may be sized or otherwise configured more appropriately for the loudspeaker 150.

Figure 2:
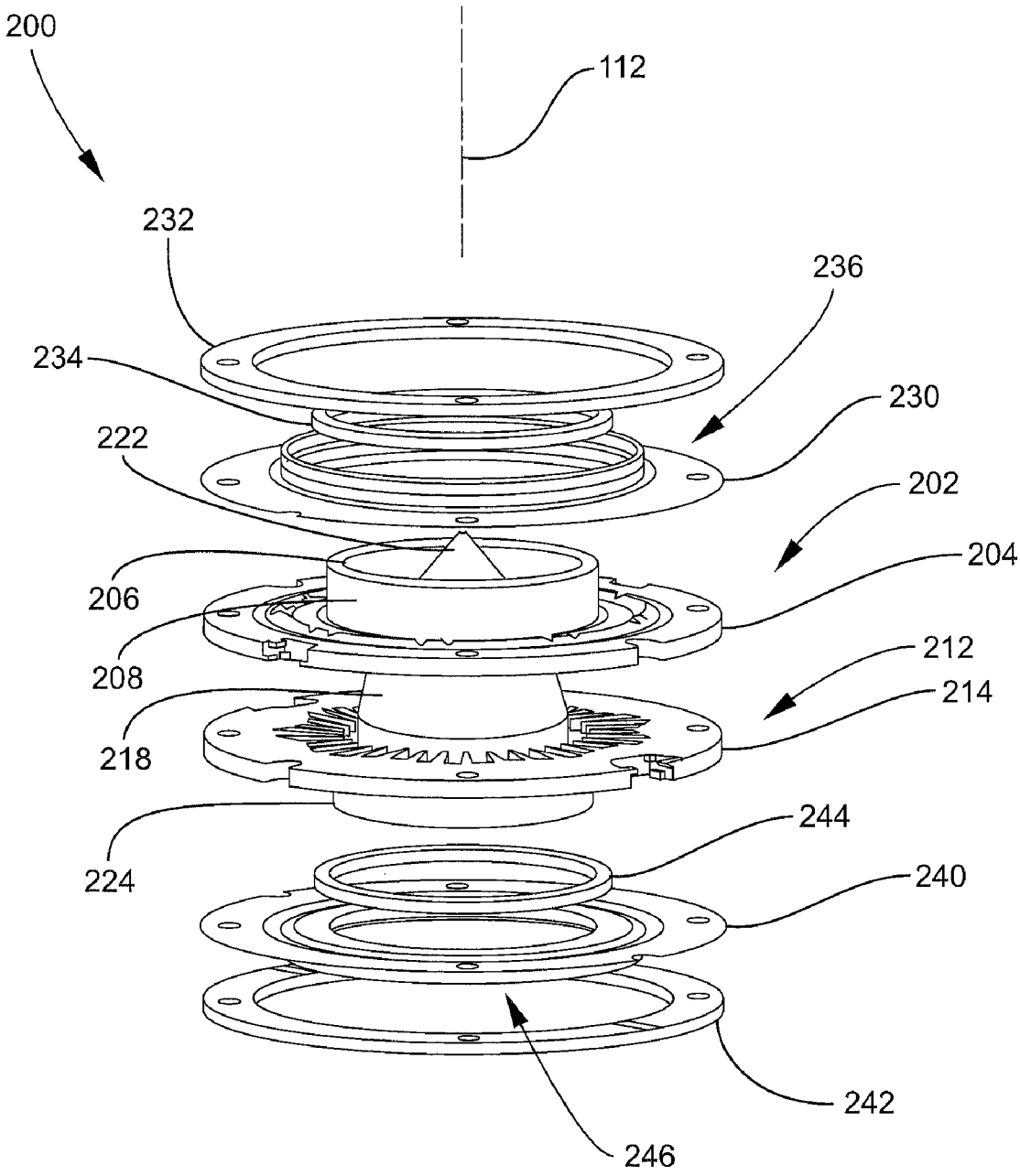
FIG. 2 is an exploded perspective view of an example of a dual phasing plug assembly that may be provided as part of a dual compression driver.

FIG. 2 is an exploded perspective view of an example of a dual phasing plug assembly 200 and associated components that may be provided as parts of a dual compression driver, which in turn may be provided as part of the transducer section 104 (FIG. 1) of the loudspeaker 100. Various components of the dual phasing plug assembly 200 may be disposed generally about the central axis 112. For descriptive purposes, some components are described as being "front" components while other components are described as being "rear" components. Relative to "rear" components, "front" components are generally closer to the side of the dual phasing plug assembly 200 at which sound waves emanate and may further propagate through a waveguide such as, for example, the horn 108 shown in FIG. 1. It will be understood, however, that the terms "front" and "rear" in this context are not intended to limit the dual phasing plug assembly 200 to any particular orientation in space.

The dual phasing plug assembly 200 includes a front (or first) phasing plug 202. The front phasing plug 202 includes a front base portion or body 204, which may be generally disk-shaped and lie in a plane orthogonal to the central axis 112, and may be generally centered about the central axis 112. A central bore 206 coaxial with the central axis 112 is formed through the thickness (axial direction) of the front base portion 204 to open at both an input side (facing upward from the perspective of FIG. 2) and an output side (facing downward) of the front base portion 204. The front phasing plug 202 may also include a hollow hub portion or conduit 208 axially extending from the input side. The conduit 208 may be provided as an annular wall coaxial with the central axis 112. The inside diameter of the conduit 208 may be substantially the same as the inside diameter of the central bore 206, at least at the juncture with the input side. The conduit 208 may be considered as an extension of the central bore 206.

The dual phasing plug assembly 200 also includes a rear (or second) phasing plug 212. The rear phasing plug 212 includes a rear base portion or body 214, which likewise may be generally disk-shaped and lie in a plane orthogonal to the central axis 112, and may be generally centered about the central axis 112. The rear phasing plug 212 may also include a hub portion 218 axially extending from an output side of the rear base portion 214. In the present example, the output side of the rear base portion 214 faces the output side of the front base portion 204. The hub portion 218 is typically bullet-shaped and accordingly may be referred to as a bullet. That is, the diameter (coaxial with the central axis 112) of the outside surface of the hub portion 218 typically tapers in the axial direction to an apex or tip 222 located on the central axis 112. The tip 222 may be relatively sharp or may be domed. The diameter of the outside surface of the hub portion 218 at the rear base portion 214 is less than the inside diameter of the central bore 206. When assembled, the hub portion 218 extends through the central bore 206—and, if provided, through the conduit 208—to an axial elevation above the front phasing plug 202. The rear phasing plug 212 may also include an annular mounting structure 224 axially extending from an input side of the rear base portion 214, which may facilitate mounting the rear phasing plug 212 to an underlying magnetic assembly (described below).

As further illustrated in FIG. 2, an annular front diaphragm 230 may be mounted at the input side of the front base portion 204 such that the front diaphragm 230 is concentric to the central bore 206. The front diaphragm 230 may be constructed of any flexible material suitable for loudspeakers, as appreciated by persons skilled in the art. An outer portion of the front diaphragm 230 may be mounted axially between the front base portion 204 and a front outer positioning ring 232. An inner portion of the front diaphragm 230 may be mounted axially between the front base portion 204 and a front inner positioning ring 234. A front voice coil assembly 236 may be attached to a movable portion of the front diaphragm 230 that is located at a transverse distance (i.e., in a direction orthogonal to the central axis 112) between the front outer positioning ring 232 and the front inner positioning ring 234. Similarly, an annular flexible rear diaphragm 240 may be mounted at the input side of the rear base portion 214 such that the rear diaphragm 240 is concentric to the mounting structure 224. An outer portion of the rear diaphragm 240 may be mounted axially between the rear base portion 214 and a rear outer positioning ring 242. An inner portion of the rear diaphragm 240 may be mounted axially between the rear base portion 214 and a rear inner positioning ring 244. A rear voice coil assembly 246 may be attached to a movable portion of the rear diaphragm 240 that is located at a transverse distance between the rear outer positioning ring 242 and the rear inner positioning ring 244.

Figure 3:
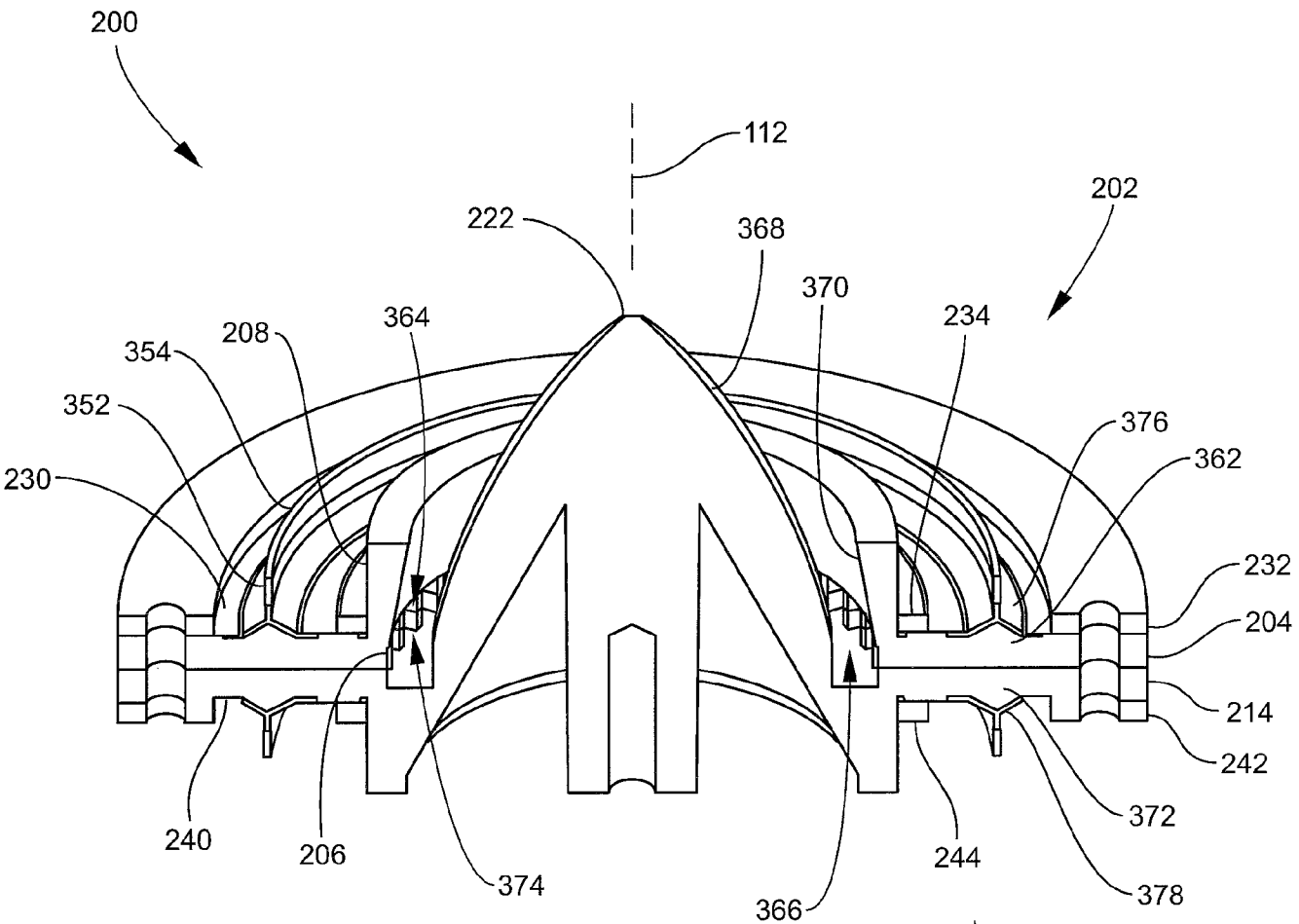
FIG. 3 is a cross-sectional perspective view of the dual phasing plug assembly illustrated in FIG. 2 with the components assembled.

FIG. 3 is a cross-sectional perspective view of the dual phasing plug assembly 200 illustrated in FIG. 2 with the components assembled. The front voice coil assembly 236 and the rear voice coil assembly 246 may have any configuration which, in response to electrodynamic excitation, respectively causes axial oscillation or translation of the front diaphragm 230 and the rear diaphragm 240 in a known manner. Accordingly, in the illustrated example the front voice coil assembly 236 includes a front voice coil 352 supported on a front voice coil former 354, and the rear voice coil assembly 246 includes a rear voice coil 356 supported on a rear voice coil former 358. The front and rear voice coil assemblies 236, 246 may be assembled and respectively attached to the front and rear diaphragms 230, 240 by any suitable means. As an example, the front and rear voice coils 352, 356 may be respectively glued to the front and rear voice coil formers 354, 358, and the front and rear voice coil formers 354, 358 may be respectively glued to the front and rear diaphragms 230, 240.

The front diaphragm 230 is clamped, on one side, between the front outer positioning ring 232 and the front base portion 204 and, on the other side, between the front inner positioning ring 234 and the front base portion 204. The input side of the front base portion 204 includes an annular region 362 between the annular clamped boundaries provided by the front outer positioning ring 232 and the front inner positioning ring 234. Within these boundaries, the front diaphragm 230 is free to translate axially toward and away from the annular region 362 in response to electromagnetic actuation of the front voice coil assembly 236 in a manner appreciated by persons skilled in the art. The front diaphragm 230 is spaced from the annular region 362 by an axial gap that varies in accordance with the axial translation of the front diaphragm 230. This axial gap defines a front compression chamber. In practice, the height of the front compression chamber (i.e., the size of the axial gap when the front diaphragm 230 is not being driven) may be quite small (e.g., approximately 0.5 mm or less) such that the volume of the front compression chamber is also small. As also illustrated in FIG. 3, a plurality of front exits 364 are formed on the output side of the front base portion 204 and are located at the central bore 206. The front exits 364 may be circumferentially spaced relative to the central axis 112.

As described further below, the front base portion 204 is configured to define a plurality of front (or first) acoustical paths that run from the front compression chamber, through the thickness of the front base portion 204 via entrances and associated channels (not shown), and to the respective front exits 364. In operation, actuation of the front diaphragm 230 by the oscillating front voice coil assembly 236 (energized by the audio signal input) generates high sound-pressure acoustical signals within the front compression chamber, and the acoustical signals travel as sound waves through the front base portion 204 along the front acoustical paths. As further illustrated in FIG. 3, an annular gap or region 366 is provided between the central bore 206 and an outside surface 368 of the hub portion 218. Each front exit 364 communicates with the annular region 366, whereby all front acoustical paths lead to and merge or sum at the common annular region 366. The acoustical signal path then turns upward (from the perspective of FIG. 3) and continues adjacent to the outside surface 368. If the conduit 208 is provided, the acoustical signals propagate between an inside surface 370 of the conduit 208 and the outside surface 368 of the hub portion 218. As further illustrated in FIG. 3, the inside surface 370 may be tapered in the axial direction away from the input side of the front base portion 204, but to a lesser degree than the outside surface 368, whereby the annular region between the inside surface 370 and the outside surface 368 defines a waveguide of increasing cross-sectional area.

As also illustrated in FIG. 3, the rear diaphragm 240 is clamped on one side between the rear outer positioning ring 242 and the rear base portion 214, and on the other side between the rear inner positioning ring 244 and the rear base portion 214. The input side of the rear base portion 214 includes an annular region 372 between the annular clamped boundaries provided by the rear outer positioning ring 242 and the rear inner positioning ring 244. Within these boundaries, the rear diaphragm 240 is free to translate axially toward and away from the annular region 372 in response to electromagnetic actuation of the rear voice coil assembly 246. The rear diaphragm 240 is spaced from the annular region 372 by an axial gap that varies in accordance with the axial translation of the rear diaphragm 240. This axial gap defines a rear compression chamber. As also illustrated in FIG. 3, a plurality of rear exits 374 are formed on the output side of the rear base portion 214 and are located at the central bore 206. The rear exits 374 may be circumferentially spaced relative to the central axis 112. As described further below, the rear base portion 214 is configured to define a plurality of rear (or second) acoustical paths that run from the rear compression chamber, through the thickness of the rear base portion 214 via entrances and associated channels (not shown), and to the respective rear exits 374. Each rear exit 374 communicates with the annular region 366, whereby all rear acoustical paths lead to and merge or sum at the common annular region 366. The acoustical signal path then turns upward and continues adjacent to the outside surface 368. As the annular region 366 is also common to the front acoustical paths, the rear acoustical paths may merge or sum with the front acoustical paths in, or in the vicinity of, the annular region 366.

In the example illustrated in FIG. 3, the front acoustical exits 364 are axially aligned with the rear acoustical exits 374. That is, each front acoustical exit 364 is located at the same circumferential position as a corresponding rear acoustical exit 374 relative to the central bore 206. Also in the example illustrated in FIG. 3, the front base portion 204 abuts (is immediately adjacent to) the rear base portion 214, such that each corresponding front acoustical exit 364 and rear acoustical exit 374 are in open communication with each other at the central bore 206 and open together into the annular region 366. In other implementations described below, a divider (not shown) separates the front base portion 204 and the rear base portion 214.

Also in the example illustrated in FIG. 3, the movable portion of the front diaphragm 230 may include a raised section such as a V-shaped section 376. The raised section may include a circular apex coaxial with the central axis 112, and the front voice coil assembly 236 may be attached to the front diaphragm 230 at the circular apex. In this example, the annular region 362 may be complementarily V-shaped to form a V-shaped front compression chamber with the front diaphragm 230. Similarly, the movable portion of the rear diaphragm 240 may include a V-shaped section 378 (or other type of raised section with a circular apex), and the annular region 372 may be complementarily V-shaped to form a V-shaped rear compression chamber with the rear diaphragm 240. The rear voice coil assembly 246 may be attached to the rear diaphragm 240 at the circular apex. Other alternatively shaped profiles may be provided for the raised sections as described below.

Figure 4:
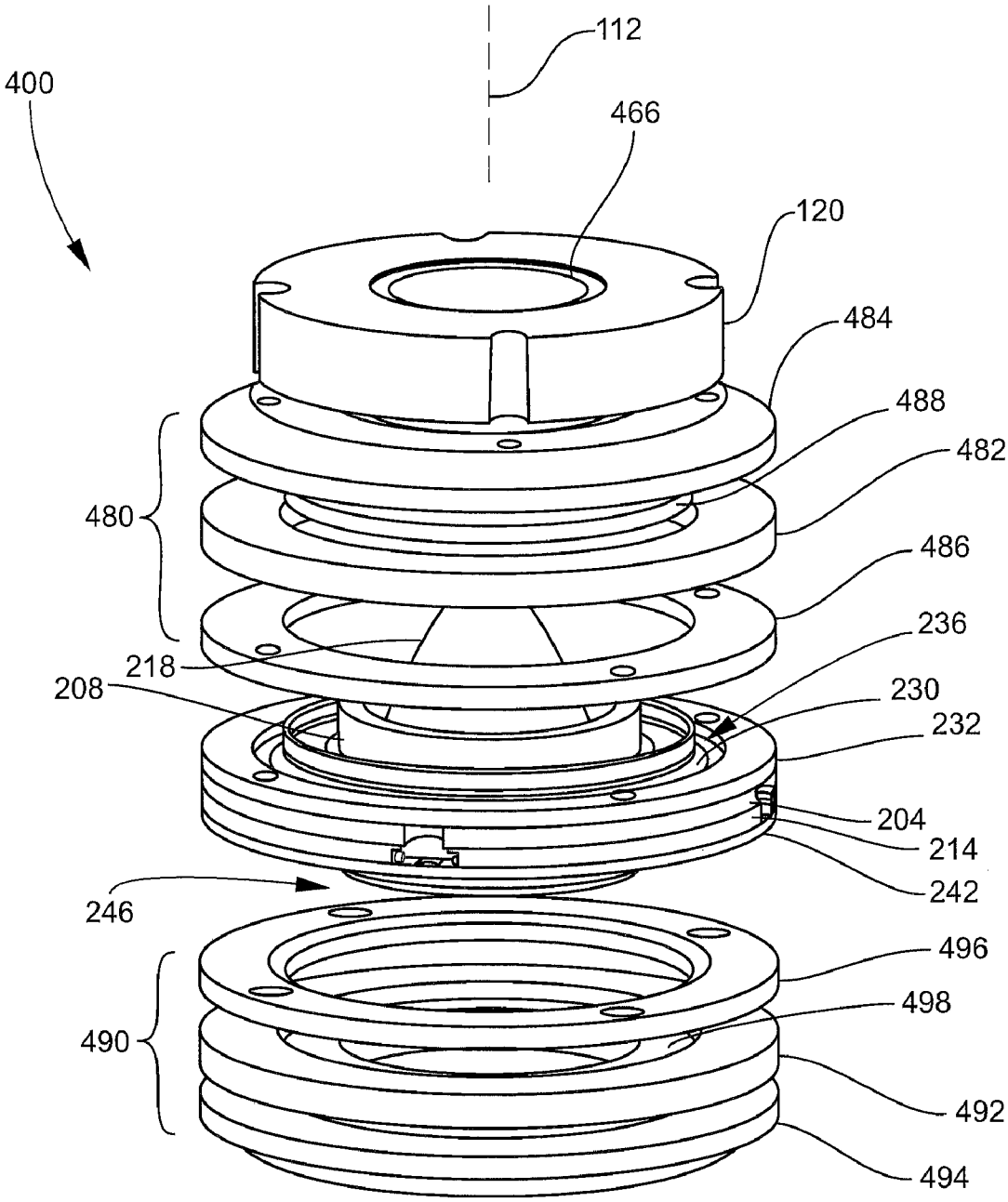
FIG. 4 is an exploded perspective view of an example of a dual compression driver.

FIG. 4 is an exploded perspective view of an example of a dual compression driver 400 that may be provided, for example, as part of the transducer section 104 (FIG. 1) of the loudspeaker 100. In this example the dual compression driver 400 may be realized by adding the front diaphragm 230, the front voice coil assembly 236, the rear diaphragm 240, and the rear voice coil assembly 246 to the dual phasing plug assembly 200 in the manner described above and illustrated in FIGS. 2 and 3, and by further adding a front magnet assembly 480 and a rear magnet assembly 490. Generally, the front magnet assembly 480 and the rear magnet assembly 490 may have any configuration suitable for providing magnetic fields useful for respectively inducing the front voice coil assembly 236 to drive the front diaphragm 230 and inducing the rear voice coil assembly 246 to drive the rear diaphragm 240, as necessary for converting inputted electrical signals into sound waves in accordance with principles understood by persons skilled in the art. In the illustrated example, the front magnet assembly 480 may include an annular front magnet 482 axially interposed between an annular front back plate 484 and an annular front top plate 486. In this example, an annular front pole piece 488 of lesser diameter than the front magnet 482 is integrated with the front back plate 484. The other components (e.g., plates/pole pieces) are typically composed of a soft magnetic material such as, for example, low-carbon steel. Likewise, the rear magnet assembly 490 may include an annular rear magnet 492 axially interposed between an annular rear back plate 494 and an annular rear top plate 496. In this example an annular rear pole piece 498 of lesser diameter than the rear magnet 492 is integrated with the rear back plate 494. The front and rear magnets 482, 492 may be composed of any permanent magnetic material suitable for use in loudspeaker drivers. The other components (e.g., plates/pole pieces) are typically composed of a soft magnetic material such as, for example, low-carbon steel.

FIG. 4 also illustrates the annular adapter 120 that may be disposed on the front side of the uppermost front plate 484. The adapter 120 circumscribes a central sound outlet 466. Depending on the application of the dual compression driver 400 to a loudspeaker of a given design, the adapter 120 may be useful for providing a mechanical and/or acoustical connection to a sound radiator such as the horn 108 illustrated in FIG. 1.

Figure 5:
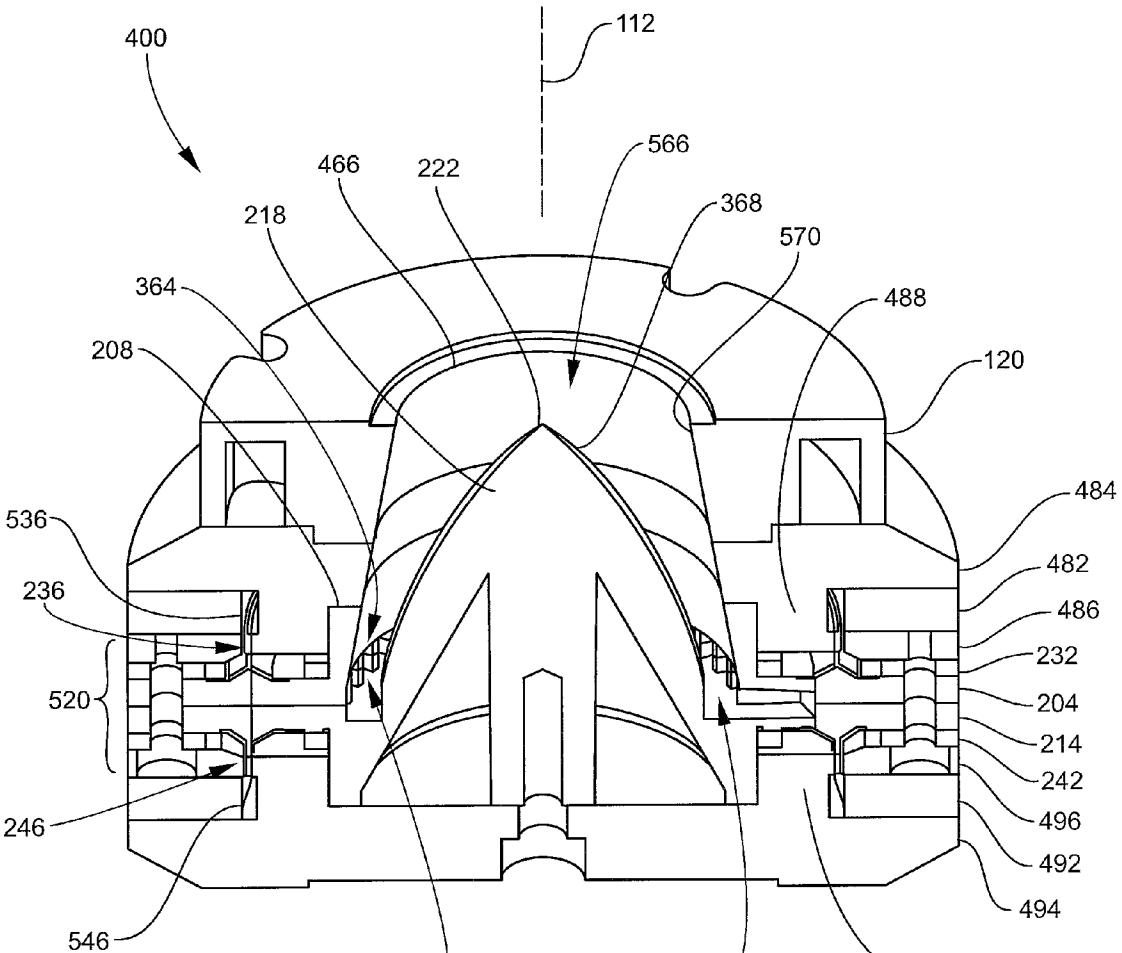
FIG. 5 is a cross-sectional perspective view of the dual compression driver illustrated in FIG. 4 with the components assembled.

FIG. 5 is a perspective view in cross-section of the dual compression driver 400 illustrated in FIG. 4 with the components assembled. The front magnet 482 provides a magnetic field across an annular air gap 536 formed between the front top plate 486 and the pole piece 488 of the front back plate 484, and the front voice coil assembly 236 is free to translate axially through the air gap 536 in a manner appreciated by persons skilled in the art. Likewise, the rear magnet 492 provides a magnetic field across an annular air gap 546 formed between the rear top plate 496 and the pole piece 498 of the rear back plate 494, and the rear voice coil assembly 246 is free to translate axially through the air gap 546. As also shown in FIG. 5, inside surfaces 570 of various annular components disposed above the annular region 366, such as the conduit 208, the front back plate 484, and the adapter 120, may form a waveguide 566 in conjunction with the outside surface 368 of the hub portion 218. The inside surfaces 570 may be tapered, but to a lesser degree than the outside surface 368, whereby the waveguide 566 provides a cross-sectional area that increases in the axial direction to the central sound outlet 466. Accordingly, the acoustical paths for sound waves generated by the dual compression driver 400 may be described as follows. First acoustical paths run from the annular front compression chamber, through the thickness of the front base portion 204 (in a manner described below) from its input side to its output side, through the respective front exits 364 and into the annular region 366. Second acoustical paths run from the annular rear compression chamber, through the thickness of the rear base portion 214 (in a manner described below) from its input side to its output side, through the respective rear exits 374 and into the annular region 366 where the second acoustical paths may merge or sum with the first acoustical paths. The sound waves from the first and second acoustical paths then turn upward and propagate through the waveguide 566 and the central sound outlet 466, and subsequently through the horn 108 (FIG. 1) or any other sound radiator or waveguide attached to the dual compression driver 400 at the central sound outlet 466. It will be noted that the horn 108 or other type of waveguide connected to the dual compression driver 400 may be considered to be part of, or an extension of, the waveguide 566 illustrated in FIG. 5. The adapter 120 (if provided) may be considered to be an intermediate part between the dual compression driver 400 and the horn 108 (or other waveguide), or may be considered to be part of or an extension of the dual compression driver 400, or may be considered to be part of or an extension of the horn 108.

As an example of assembling the dual compression driver 400, the front magnet assembly 480 may be assembled by gluing together the front back plate 484, the front magnet 482 and the front top plate 486. The rear magnet assembly 490 may be assembled by gluing together the rear top plate 496, the rear magnet 492 and the rear back plate 494. In this example, the front pole piece 488 is integral with the front back plate 484 and the rear pole piece 498 is integral with the rear back plate 494, so the front and rear pole pieces 488, 498 do not require separate mounting. The dual phasing plug assembly 200 may be assembled by threading bolts (not shown) through axially aligned bores of the various annular components of the dual phasing plug assembly 200. Some of these bores are shown in FIGS. 4 and 5. At least some of these bores may be threaded to mate with the threads of the bolts. The dual phasing plug assembly 200 may be secured to the front magnet assembly 480 by further threading the bolts through additional axially aligned bores formed in one or more annular components of the front magnet assembly 480. In this example, the upper rear plate 496 includes blind holes axially aligned with the bores but of greater diameter to accommodate the heads of the bolts. Thus, after installing the bolts to secure the dual phasing plug assembly 200 to the front magnet assembly 480, the rear magnet assembly 490 may be brought into abutment with the dual phasing plug assembly 200 such that the heads of the bolts are seated in these blind holes. A bolt outline 520 resulting from the axially aligned bores and corresponding blind hole is evident in FIG. 5. Finally, the rear magnet assembly 490 may be secured to the dual phasing plug assembly 200 by threading another bolt (not shown) through centrally located, axially aligned bores of the lower rear plate 494 and the hub portion 218 of the rear phasing plug 212, as shown in FIG. 5. The adapter 120 may also be bolted between the upper front plate 484 and a sound radiator (e.g., the horn 108 of FIG. 1) as appropriate.

Figure 6:
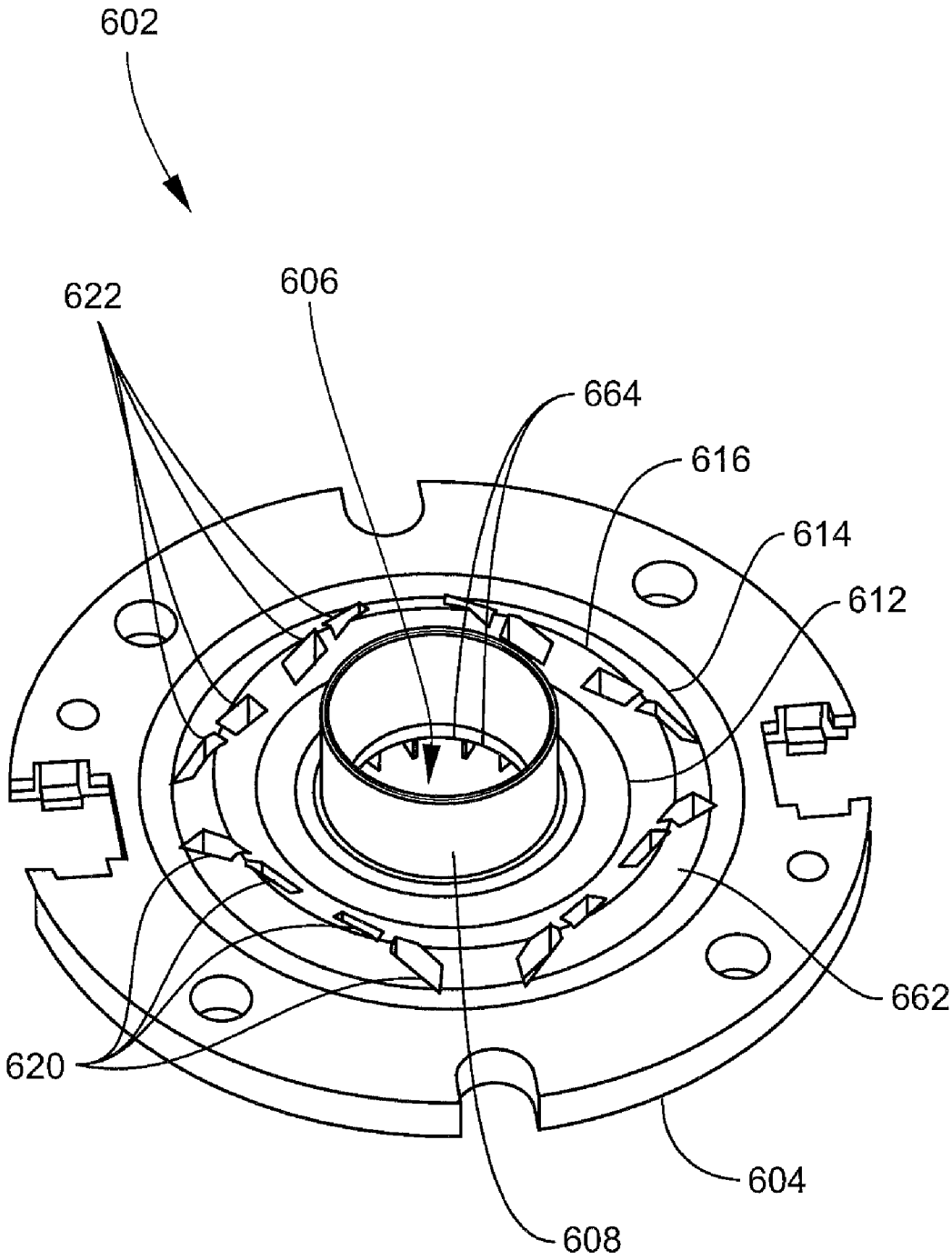
FIG. 6 is a perspective view of an example of a phasing plug from an input side, which may, for example, be utilized as a front phasing plug in the dual compression driver illustrated in FIGS. 4 and 5.

FIG. 6 is a perspective view of an example of a phasing plug 602 that may, for example, be utilized as a front phasing plug in the dual compression driver 400 (FIGS. 4 and 5). The perspective is from an input side that would face the front diaphragm 230 of the dual compression driver 400. It will be noted that the phasing plug 602 is a smaller-sized version than the phasing plug 202 shown in FIGS. 2-5, and thus in practice would be implemented in a driver utilizing a smaller-diameter voice coil. The phasing plug 602 includes a base portion 604, a central bore 606, and a conduit 608 aligned with the central bore 606. The base portion 604 includes an annular compression region 662 located so as to be underneath the movable portion of the front diaphragm 230. As noted above, the compression region 662 may have a raised profile (e.g., V-shape or other shape), which in FIG. 6 is generally demarcated by an inner circle (or circumference) 612, an outer circle (or circumference) 614, and a circular apex 616. A plurality of acoustical entrances 620 is located on the input side in the compression region 662. The entrances 620 extend as channels (not shown, but see FIG. 8) through the thickness of the base portion 604 to respective acoustical exits 664 located on the output side, thus establishing acoustical paths as described above. The entrances 620 may have any suitable shapes. Each entrance 620 may have a dominant dimension in one direction as in the case of a slot or slit. In the illustrated example, the entrances 620 are shaped as slots with straight edges, including outermost edges 622 ("outermost" being relative to distance from the central axis). The plurality of entrances 620 may be arranged according to a desired pattern (such as from the perspective of a plane orthogonal to the central axis 112). For this purpose, the plurality of entrances 620 may be arranged into groups or sets of similarly oriented entrances 620. In the illustrated example, four groups are provided with each group including four entrances 620. In the illustrated example, each set of four entrances 620 is linearly arranged. In other examples, a set of entrances may be arranged along an arcuate path that is either concave or convex relative to the central axis. In still other examples, an entrance may have a dominant dimension that is arcuate such that the entrance itself is shaped as an arcuate opening instead of a straight-edged opening.

The total number of entrances 620 and the cross-sectional areas of the entrances 620 may be selected according to the compression ratio desired for a particular application. Generally, the compression ratio is determined from the relationship between the effective area of the diaphragm and the effective area of the entrance into the phasing plug 602. The effective area of the diaphragm is the portion of the diaphragm that serves as a boundary of, and hence partially defines, the compression chamber. The effective area of the entrance into the phasing plug 602 is the total cross-sectional area of all of the individual entrances 620. The compression ratio affects the efficiency of the compression driver and influences the shape of the frequency response, and therefore the number and size of the entrances 620 should be carefully selected.

Figure 7:
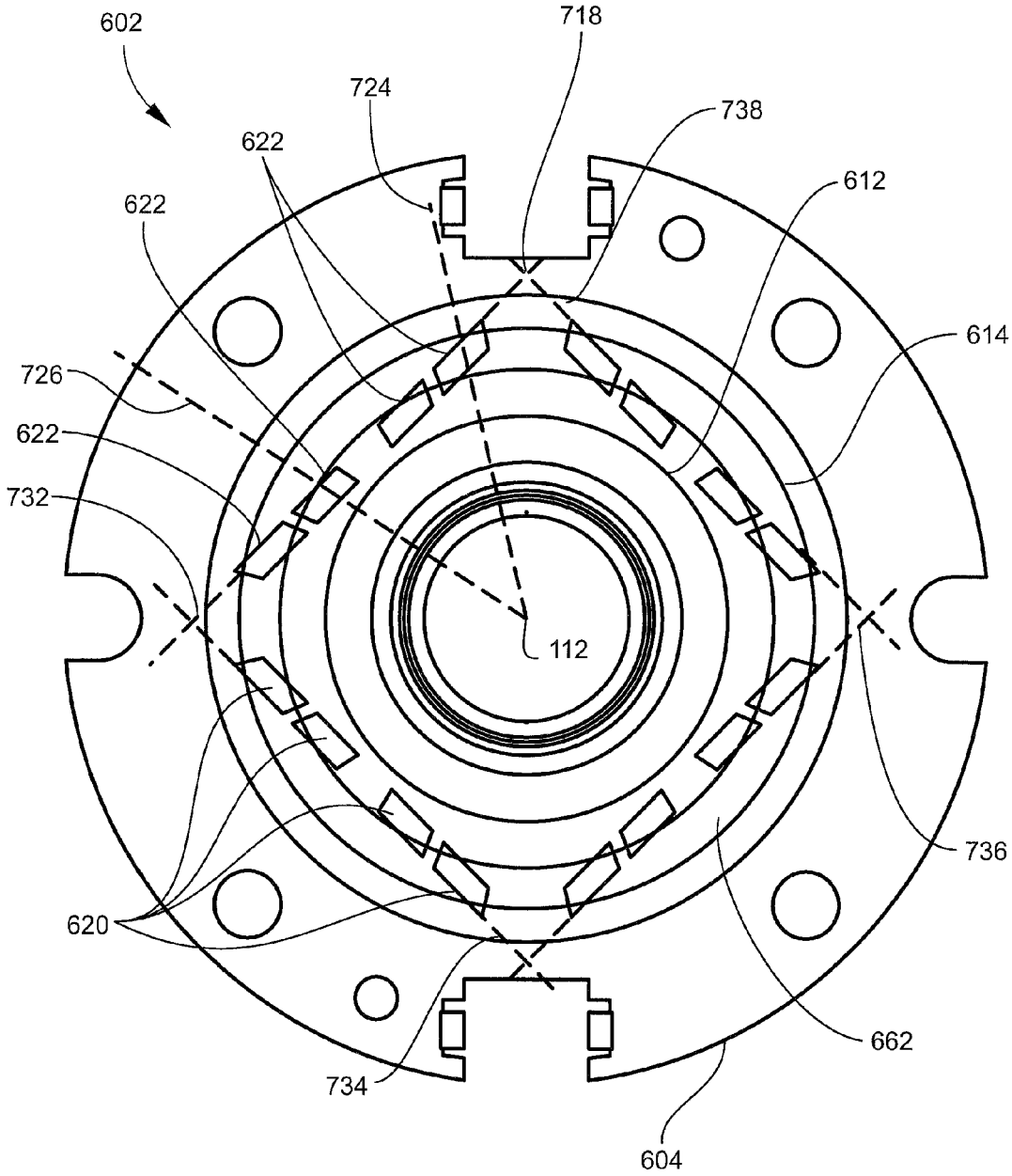
FIG. 7 is a plan view of the phasing plug illustrated in FIG. 6 from the perspective of the input side.

FIG. 7 is a plan view of the phasing plug 602 illustrated in FIG. 6 from the perspective of the input side. The plurality of entrances 620 may be patterned so as to have one or more of the following attributes. In one aspect, the orientation of each entrance 620 may be non-radial and non-circumferential relative to the central axis 112. That is, the entrances 620 are not aligned with radii extending orthogonally from the central axis 112 and therefore are not circumferentially spaced from each other (e.g., along a circle) relative to the central axis 112. For instance, in the illustrated example in which the entrances 620 are slot-shaped, if the entrances 620 were arranged in radial orientations their outermost edges 622 would intersect radii orthogonally, i.e., would be perpendicular to radii projecting through the entrances 620. Instead, in the illustrated example the entrances 620 (and their outermost edges 622) are oriented at non-ninety-degree acute angles to the radii. This configuration is illustrated in FIG. 7 by two radii 724, 726 projecting from the central axis 112 through two arbitrarily selected entrances 620. Despite the non-radial configuration, however, the pattern of entrances 620 as a whole may be symmetrical relative to the central axis 112, as in the illustrated example. In another aspect, the entrances 620 may be arranged along one or more lines that run diagonally across the annular compression region 662. In the illustrated example, each group of four entrances cuts diagonally across the compression region 662. In another aspect, the entrances 620 may be arranged along one or more lines that are diagonal relative to the central axis 112. In the present context, a diagonal line is collinear with a chord of a circle concentric with the central axis 112, or is a line that is tangential to a circle concentric with the central axis 112. In the illustrated example, using the outermost edge 622 of each entrance 620 as a datum, four lines 732, 734, 736, 738 have been drawn coincident with the outermost edges 622 of the entrances 620 of the four respective groups. Each line 732, 734, 736, 738 is a chord of the outer circle 614 or the circular apex 616 of the compression region 662. In another aspect, the entrances 620 lie on the perimeter of a closed polygon associated with a plane (orthogonal to the central axis 112) in which the base portion 604 resides. Typically, the closed polygon will have at least four corners or vertices, and may be centered about the central axis 112. In the illustrated example, using the previously drawn lines 732, 734, 736, 738, the entrances 620 lay on the perimeter of a quadrangle (with four vertices), such as a rhomboid, parallelogram, rectangle, or as in the specific example, a square. As an example, a vertex 718 is designated at the intersection of the lines 732 and 738.

Figure 8:
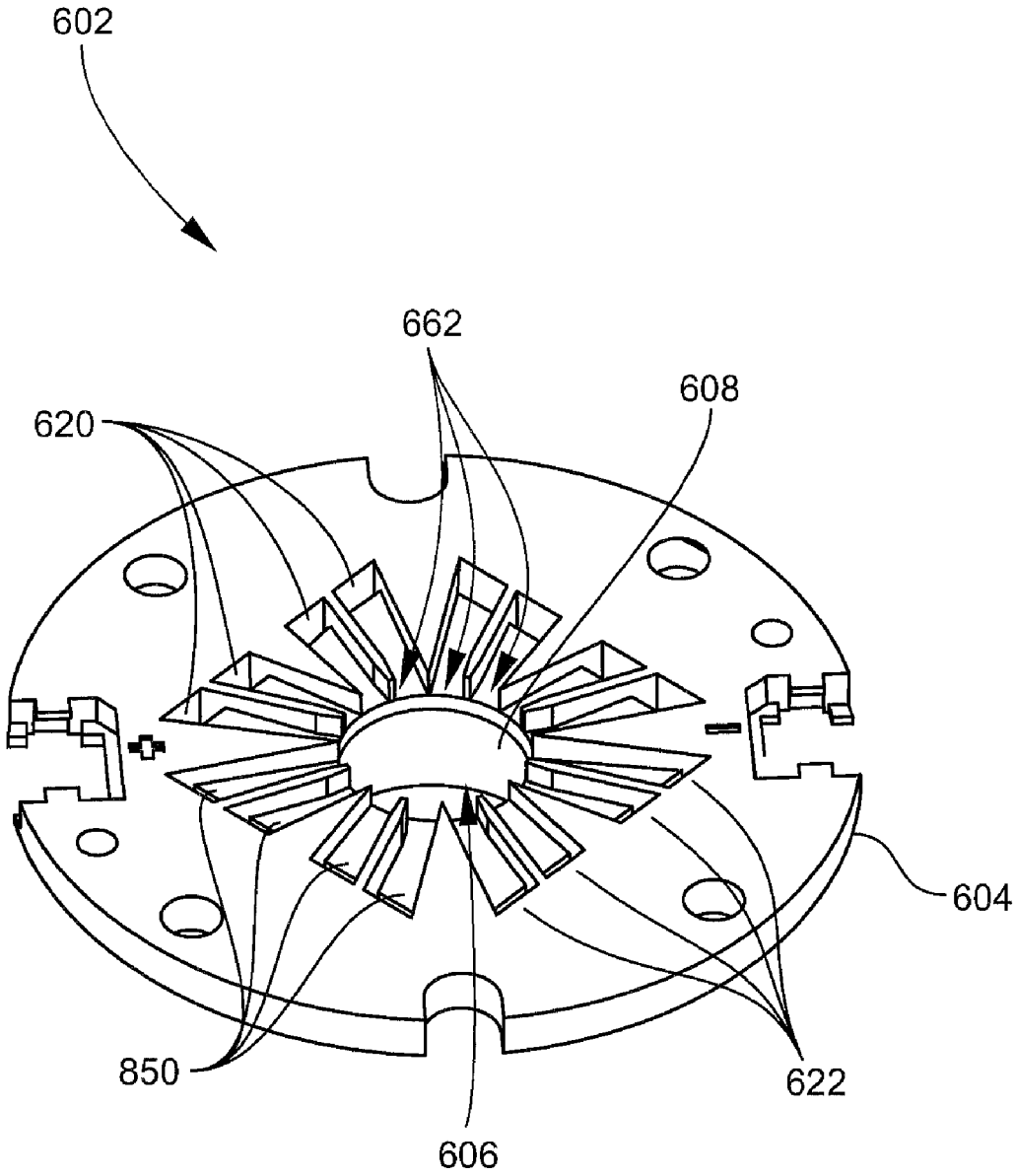
FIG. 8 is another perspective view of the phasing plug illustrated in FIGS. 6 and 7 from an output side opposite to the input side.

FIG. 8 is another perspective view of the phasing plug 602 illustrated in FIGS. 6 and 7 from an output side opposite to the input side. A plurality of channels or grooves 850 is formed on the output side. The channels 850 respectively interconnect the entrances 620 with corresponding exits 664. Accordingly, each acoustical path runs from the compression chamber on the input side, into one of the entrances 620, through the thickness of the base portion 604 to the corresponding channel 850 communicating with that entrance 620, through the corresponding exit 664 on the output side, and into the central bore 606. Corresponding entrances 620, channels 850 and exits 664 may be considered as respective acoustical connectors that extend through the thickness of the phasing plug 602. The height and width of each channel 850 may be constant or may vary. The channels 850 may be provided in the form of recesses that extend into the thickness of the base portion 604 from the output side, as shown by example in FIG. 8. The manner by which the channels 850 are bounded from above (from the perspective of FIG. 8) depends on the implementation. In implementations such as illustrated in FIGS. 3 and 5 in which the rear phasing plug directly abuts the front phasing plug, the channels 850 of the front phasing plug 602 may be in open communication with complementary channels of the rear phasing plug. In other implementations such as described below, a dividing plate may abut the phasing plug 602 and consequently cover the channels 850.

Figure 9:
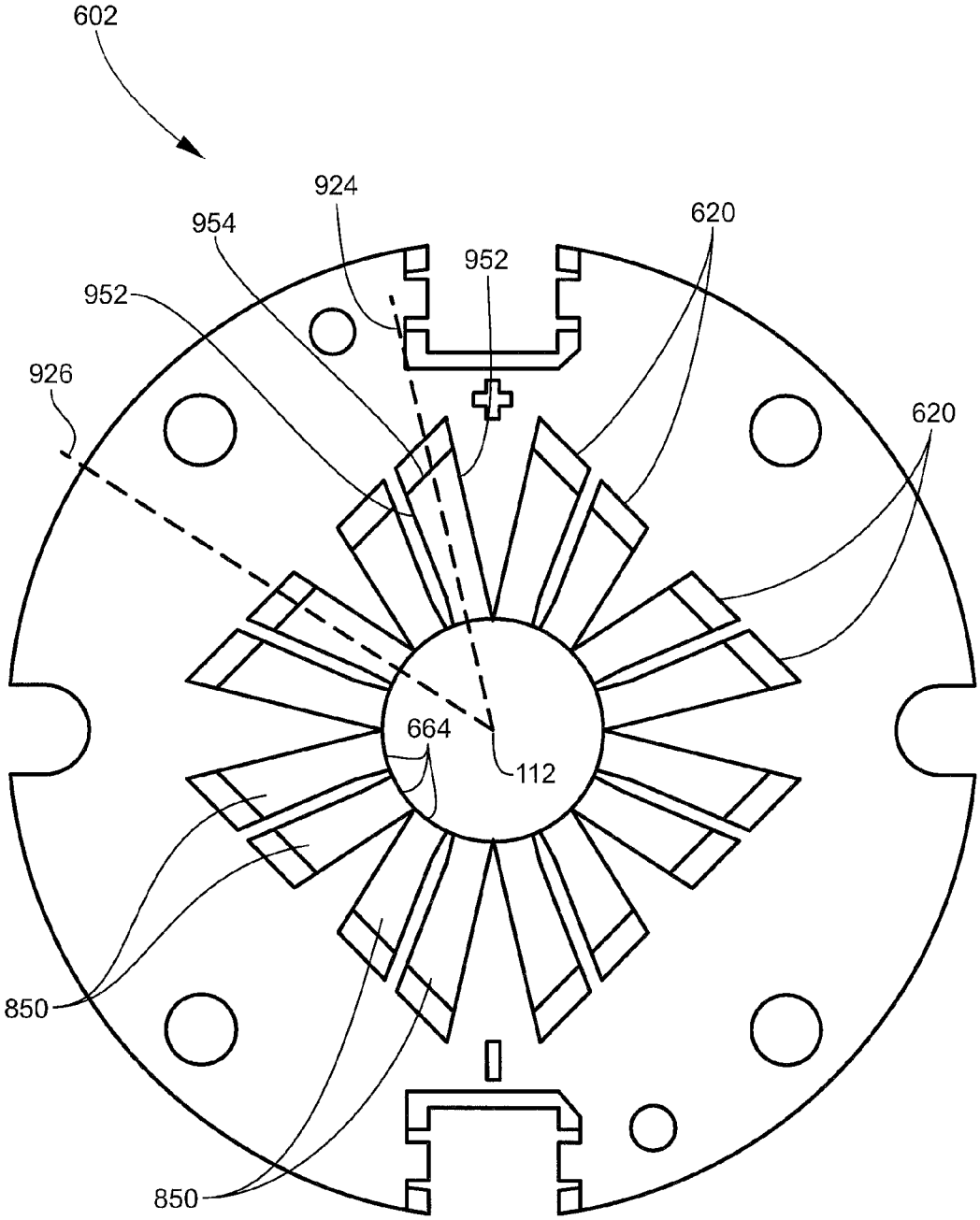
FIG. 9 is a plan view of the phasing plug illustrated in FIGS. 6-8 from the perspective of the output side.

FIG. 9 is a plan view of the phasing plug 602 illustrated in FIGS. 6-8 from the perspective of the output side. The pattern of the channels 850 and the resulting acoustical paths may have the same or analogous attributes as those described above regarding the entrances 620. For example, the orientation of each channel 850 and associated acoustical path may be non-radial relative to the central axis 112. That is, the channels 850 do not radiate from the central axis 112 as spokes from the hub of a wheel. For instance, the boundaries of the channels 850, such as side walls 952 and junctions 954 with the entrances 620, are neither parallel with nor perpendicular to any radii (e.g., radii 924 and 926) emanating from the central axis 112. Instead, such boundaries are oriented at non-ninety-degree angles to the radii. In another aspect, the entrances 620 are non-parallel with (and not radially aligned with) the exits 664. This may be further seen in FIG. 8 by looking at the cross-sectional area of one of the entrances 620 and comparing it to the cross-sectional area of the corresponding channel 850, for example where the channel 850 adjoins the entrance 620. As also shown in FIG. 9, the lengths (i.e., in a general direction from the exits 664 to the entrances 620) of one or more channels 850 may differ from the lengths of the other channels 850. In the illustrated example, two of the channels 850 in each group are shorter than the other two channels 850 in the group. The pattern of entrances 620 and channels 850 as a whole, however, may be symmetrical relative to the central axis 112, as in the illustrated example.

The non-radial, diagonal orientation of the entrances enables acoustical signals (sound pressure signals) to be picked up from the different parts of the compression chamber in both radial and circumferential directions. This configuration enables the "averaging" of acoustical signals that potentially have different phases. Moreover, the provision of channels 850 of different lengths mitigates possible resonances in the channels 850. By contrast, the positions of equal-length radial slots and channels such as described in the Related. Art section above may coincide with the positions of circumferential resonances in the compression chamber, which may cause severe irregularity in the frequency response.

Figure 10:
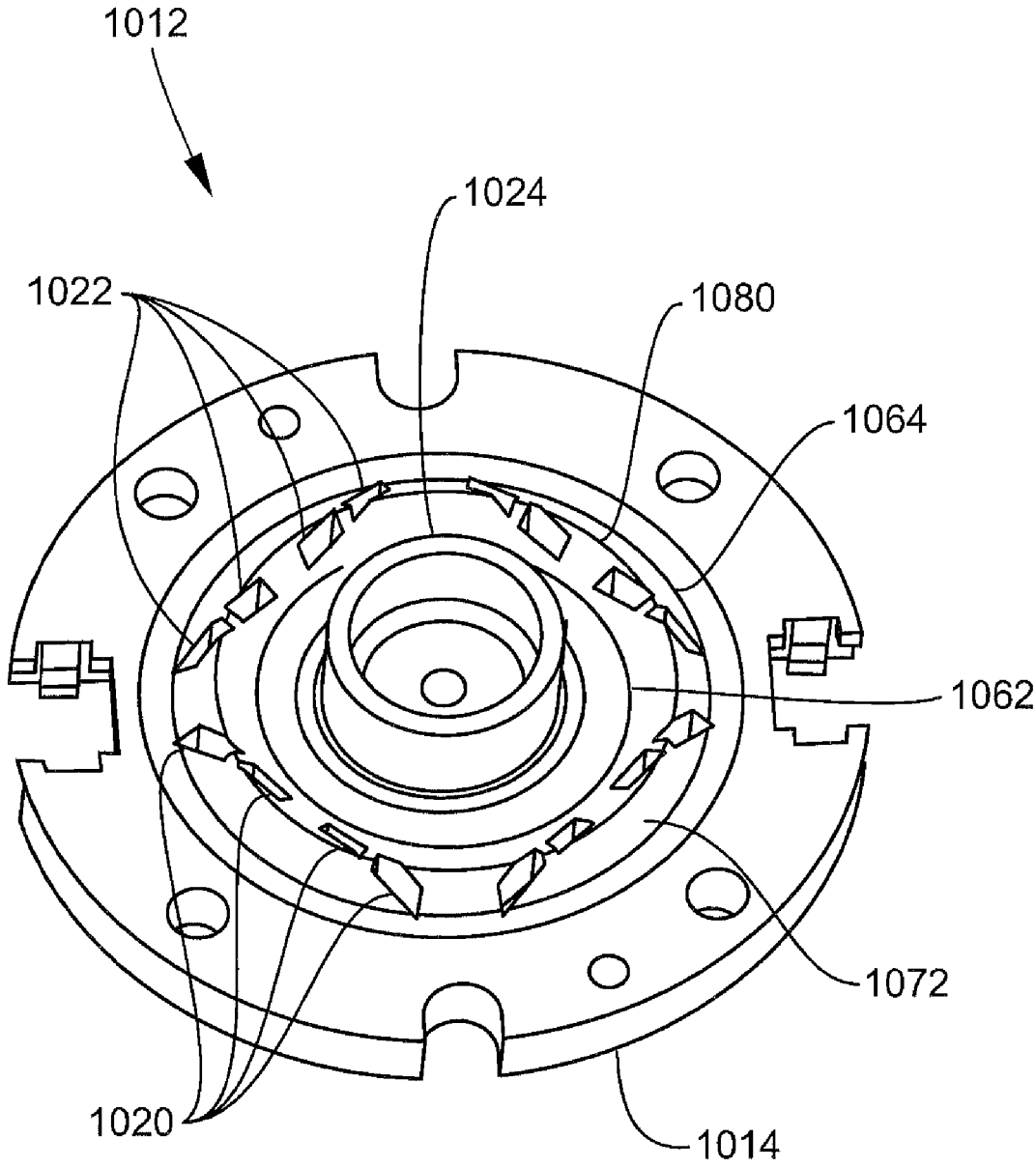
FIG. 10 is a perspective view of an example of a phasing plug from an input side, which may, for example, be utilized as a rear phasing plug in the dual compression driver illustrated in FIGS. 4 and 5.

FIG. 10 is a perspective view of an example of a phasing plug 1012 that may, for example, be utilized as a rear phasing plug in the dual compression driver 400 (FIGS. 4 and 5) in conjunction with the front phasing plug 602 described above and illustrated in FIGS. 6-9. The perspective is from an input side that would face the rear diaphragm 240 of the dual compression driver 400. The phasing plug 1012 includes a base portion 1014 and a mounting feature 1024 concentric with the central axis. The base portion 1014 includes an annular compression region 1072 located so as to be above (from the perspective of FIGS. 2-5) the movable portion of the rear diaphragm 240. As noted above, the compression region 1072 may have a raised profile (e.g., V-shape or other shape), which in FIG. 10 is generally demarcated by an inner circle 1062, an outer circle 1064, and a circular apex 1080. A plurality of acoustical entrances 1020 is located on the input side in the compression region 1072. The entrances 1020 extend as channels (not shown, but see FIG. 11) through the thickness of the base portion 1014 to respective acoustical exits (not shown) located on the output side, thus establishing acoustical paths as described above. The entrances 1020 may have any suitable shapes. In the illustrated example, the entrances 1020 are shaped as slots with straight edges, including outermost edges 1022 ("outermost" being relative to distance from the central axis). The plurality of entrances 1020 may be arranged according to a desired pattern. For this purpose, the plurality of entrances 1020 may be arranged into groups or sets of similarly oriented entrances 1020. In some implementations as in the illustrated example, particularly when the rear phasing plug 1012 is to be disposed in direct abutment with the front phasing plug 602, the pattern of entrances 1020 of the rear phasing plug 1012 matches and is axially aligned with the pattern of entrances 620 of the front phasing plug 602. Hence, in the illustrated example four groups are provided with each group including four entrances 1020. The total number of entrances 1020 and the cross-sectional areas of the entrances 1020 may be selected according to the compression ratio desired for a particular application.

Particularly in matching implementations, the plurality of entrances 1020 of the rear phasing plug 1012 may be patterned so as to have one or more of the same attributes as described above in conjunction with the entrances 620 of the front phasing plug 602. Thus, the orientation of each entrance 1020 may be non-radial and non-circumferential relative to the central axis. The entrances 1020 may be arranged along one or more lines (such as lines coincident with the outermost edges 1022) that run diagonally across the annular compression region 1072. The entrances 1020 may lie on the perimeter of a closed polygon associated with a plane in which the base portion 1014 resides, such as the same type of quadrangle as illustrated in FIG. 7.

Figure 11:
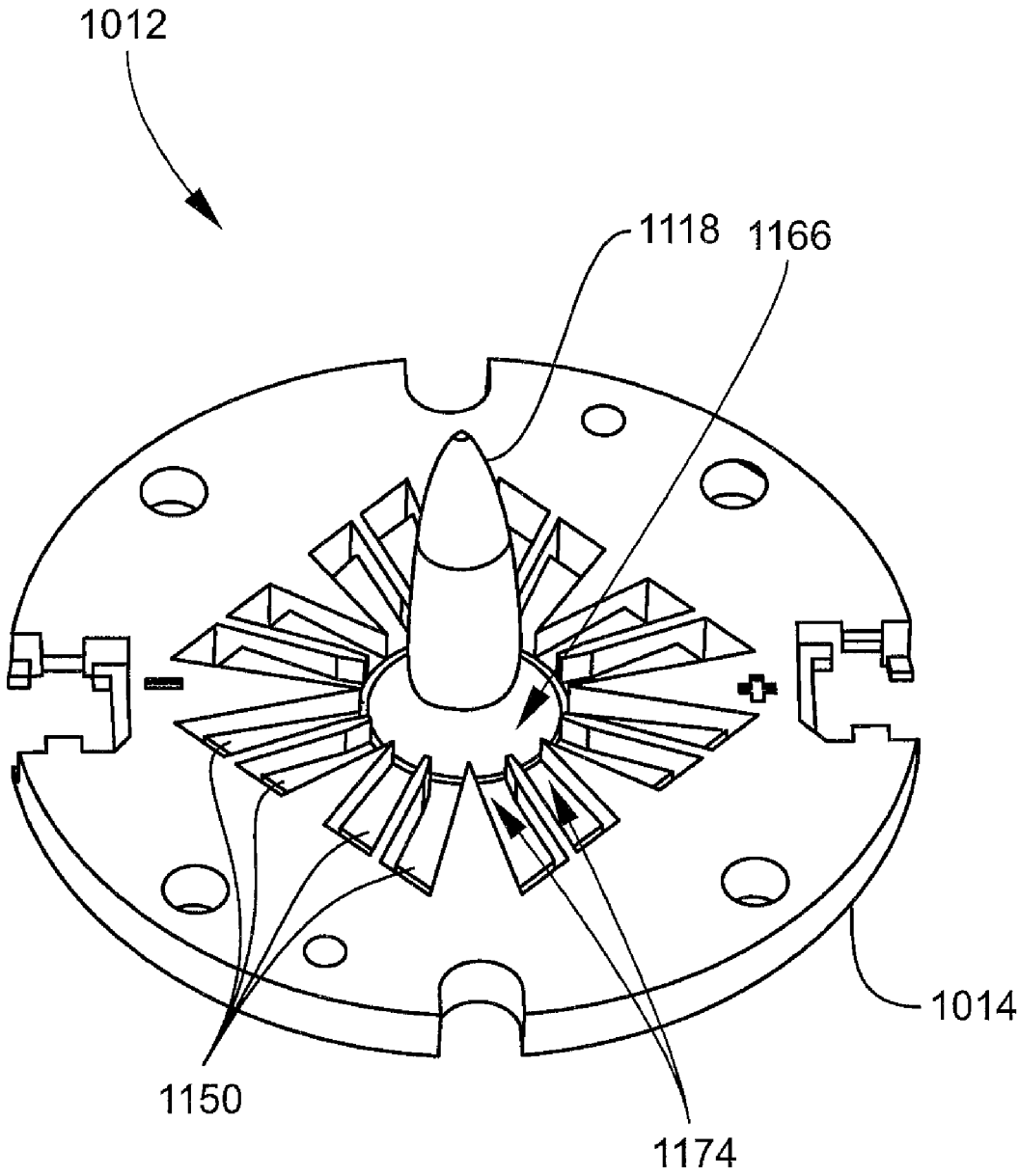
FIG. 11 is another perspective view of the phasing plug illustrated in FIG. 10 from an output side opposite to the input side.

FIG. 11 is another perspective view of the phasing plug 1012 illustrated in FIG. 10 from an output side opposite to the input side. A plurality of channels or grooves 1150 is formed on the output side. The channels 1150 respectively interconnect the entrances 1020 with corresponding exits 1174. The phasing plug further includes a centrally located hub portion 1118 that may be shaped as a bullet as described above. An annular region 1166 is defined between the hub portion 1118 and the surrounding exits 1174. Accordingly, each acoustical path runs from the compression chamber on the input side, into one of the entrances 1020, through the thickness of the base portion 1014 to the corresponding channel 1150 communicating with that entrance 1020, through the corresponding exit 1174 on the output side, and into the annular region 1166. The channels 1150 may be configured in the same manner as illustrated in FIGS. 8 and 9. In implementations in which the rear phasing plug 1012 directly abuts the front phasing plug 602, the channels 1150 of the rear phasing plug 1012 may be in open communication with corresponding channels 850 of the front phasing plug 602. In this case, corresponding pairs of front channels 850 and rear channels 1150 may be considered as forming combined or common channels, and the front acoustical paths may be considered as merging or summing with the rear acoustical paths in the corresponding pairs of channels 850, 1150. In other implementations such as described below, a dividing plate may be positioned to axially separate the channels 1150 of the rear phasing plug 1012 from the channels 850 of the front phasing plug 602. The pattern of the channels 1150 and the resulting acoustical paths may have the same or analogous attributes as those described above regarding the front phasing plug 602. For example, the orientation of each channel 1150 and associated acoustical path may be non-radial relative to the central axis. The entrances 1020 may be non-parallel with (and not radially aligned with) the exits 1174. The lengths of one or more channels 1150 may differ from the lengths of the other channels 1150. The pattern of channels 1150 may or may not be symmetrical relative to the central axis.

Figure 12:
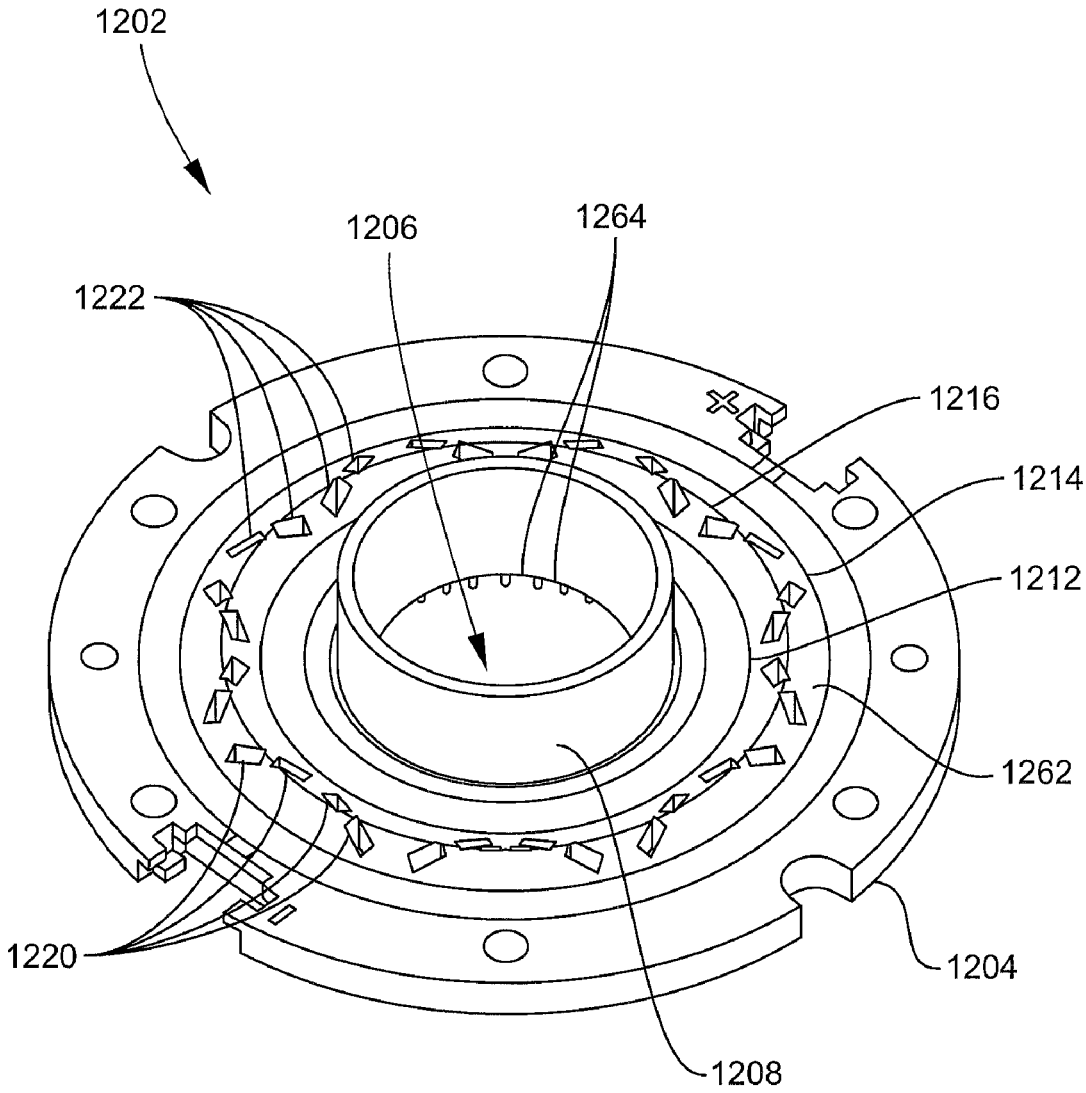
FIG. 12 is a perspective view of another example of a phasing plug from an input side, which may, for example, be utilized as a front phasing plug in the dual compression driver illustrated in FIGS. 4 and 5.

FIG. 12 is a perspective view of another example of a phasing plug 1202 that may, for example, be utilized as a front phasing plug in the dual compression driver 400 (FIGS. 4 and 5). The perspective is from an input side that would face the front diaphragm 230 of the dual compression driver 400. The phasing plug 1202 includes a base portion 1204, a central bore 1206, and a conduit 1208 aligned with the central bore 1206. The base portion 1204 includes an annular compression region 1262 located so as to be underneath the movable portion of the front diaphragm 230. As noted above, the compression region 1262 may have a raised profile (e.g., V-shape or other shape), which in FIG. 12 is generally demarcated by an inner circle 1212, an outer circle 1214, and a circular apex 1216. A plurality of acoustical entrances 1220 is located on the input side in the compression region 1262. The entrances 1220 extend as channels (not shown, but see FIG. 14) through the thickness of the base portion 1204 to acoustical exits 1264 located on the output side, thus establishing acoustical paths as described above. The entrances 1220 may have any suitable shapes. In the illustrated example, the entrances 1220 are shaped as slots with straight edges, including outermost edges 1222. The plurality of entrances 1220 may be arranged according to a desired pattern. For this purpose, the plurality of entrances 1220 may be arranged into groups or sets of similarly oriented entrances 1220. In the illustrated example, sixteen groups are provided with each group including two entrances 1220. The total number of entrances 1220 and the cross-sectional areas of the entrances 1220 may be selected according to the compression ratio desired for a particular application.

Figure 13:
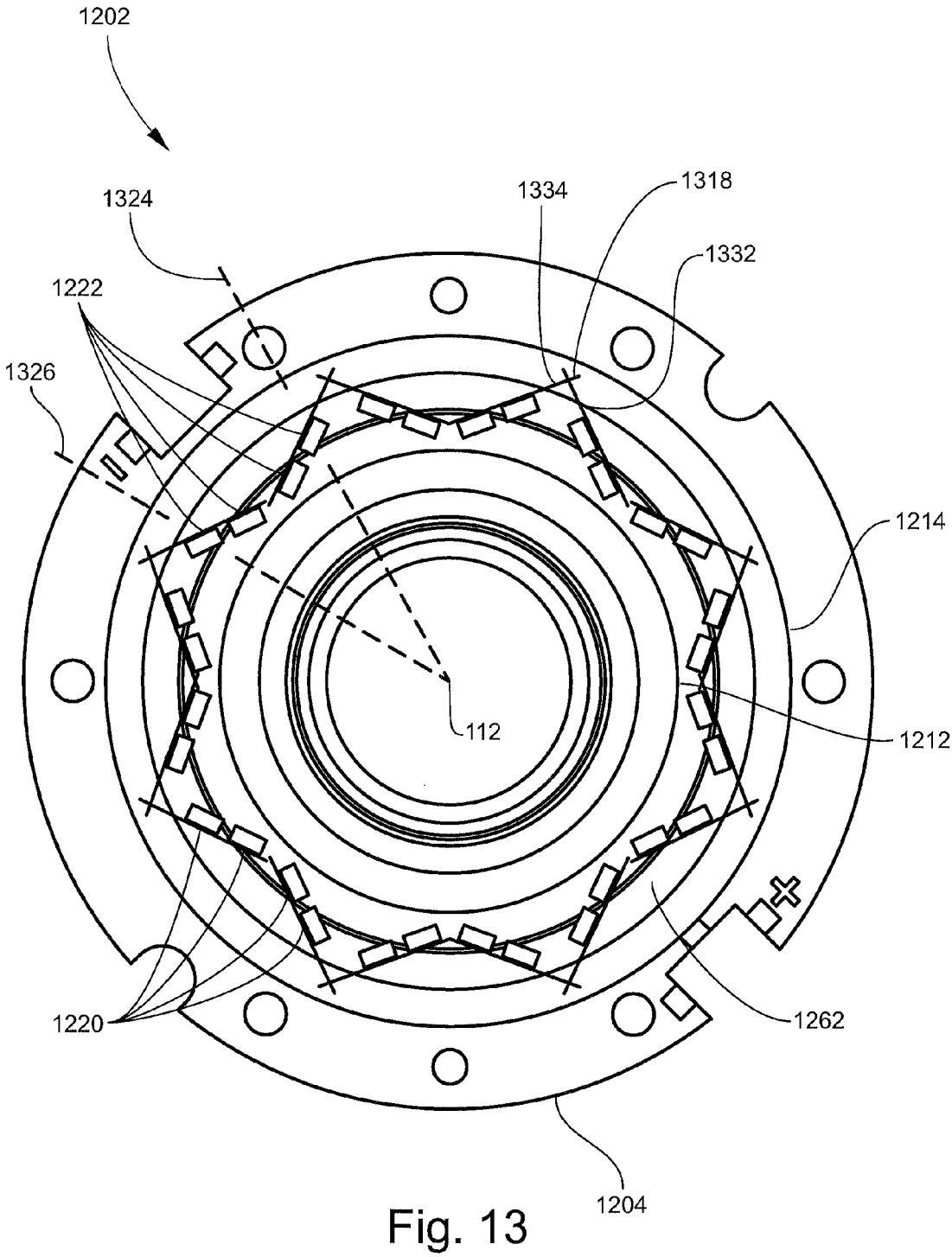
FIG. 13 is a plan view of the phasing plug illustrated in FIG. 12 from the perspective of the input side.

FIG. 13 is a plan view of the phasing plug 1202 illustrated in FIG. 12 from the perspective of the input side. The plurality of entrances 1220 may be patterned so as to have one or more of the same or analogous attributes as described above in conjunction with the implementation illustrated in FIGS. 6-11. As examples, the orientation of each entrance 1220 may be non-radial and non-circumferential relative to the central axis 112. This configuration is illustrated in FIG. 13 by two radii 1324, 1326 projecting from the central axis 112 through two arbitrarily selected entrances 1220. Despite the non-radial configuration, however, the pattern of entrances 1220 as a whole may be symmetrical relative to the central axis 112, as in the illustrated example. In another aspect, the entrances 1220 may be arranged along one or more lines that run diagonally across the annular compression region 1262. In FIG. 13, this configuration is illustrated by a line 1332 coincident with the outermost edges 1222 of one representative pair of entrances 1220 and a line 1334 coincident with the outermost edges 1222 of a neighboring or adjacent pair of entrances 1220. The two lines 1332, 1334 intersect at a vertex 1318, and this pattern may be repeated for the rest of the entrances 1220 to form a closed perimeter. The lines 1332, 1334 may be straight or arcuate (concave or convex). In the illustrated example, each group of two entrances 1220 cuts diagonally across the compression region 1262, such as along one diagonal direction (e.g., line 1332) or another diagonal direction (e.g., line 1334). In another aspect, the entrances 1220 may be arranged along one or more lines that are diagonal relative to the central axis 112. In another aspect, the entrances 1220 may lay on the perimeter of a closed polygon associated with a plane in which the base portion 1204 resides. In the illustrated example, the closed polygon has eight vertices (such as vertex 1318) while in other examples may have more or less vertices. In the illustrated example, as partially represented by the previously drawn lines 1332, 1334, the entrances 1220 lay on the perimeter of an eight-pointed star, while in other examples the star may have more or less points (or vertices). Alternatively, the vertices may be considered as being the corners of a polygon. Hence, in the illustrated example the eight-pointed star may be considered as being inscribed by an octagon, with the points of the star being coincident with the corners of the octagon. Other patterns entailing more or less vertices or corners may be realized, such as a six-pointed star or hexagon, a ten-pointed star or decagon, etc.

Figure 14:
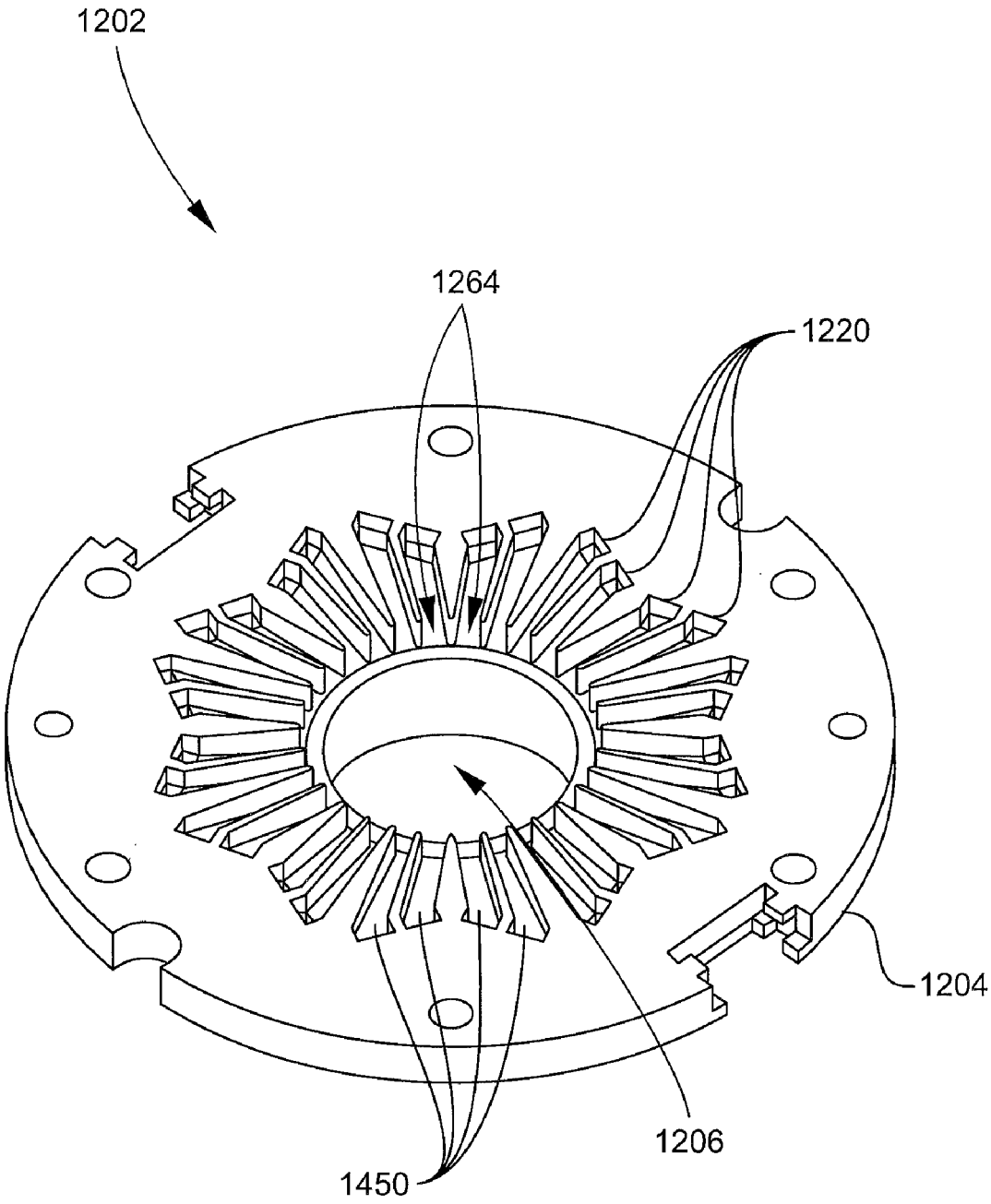
FIG. 14 is another perspective view of the phasing plug illustrated in FIGS. 12 and 13 from an output side opposite to the input side.

FIG. 14 is another perspective view of the phasing plug 1202 illustrated in FIGS. 12 and 13 from an output side opposite to the input side. A plurality of channels or grooves 1450 is formed on the output side. The channels 1450 respectively interconnect the entrances 1220 with corresponding exits 1264. Accordingly, each acoustical path runs from the compression chamber on the input side, into one of the entrances 1220, through the thickness of the base portion 1204 to the corresponding channel 1450 communicating with that entrance 1220, through the corresponding exit 1264 on the output side, and into the central bore 1206.

Figure 15:
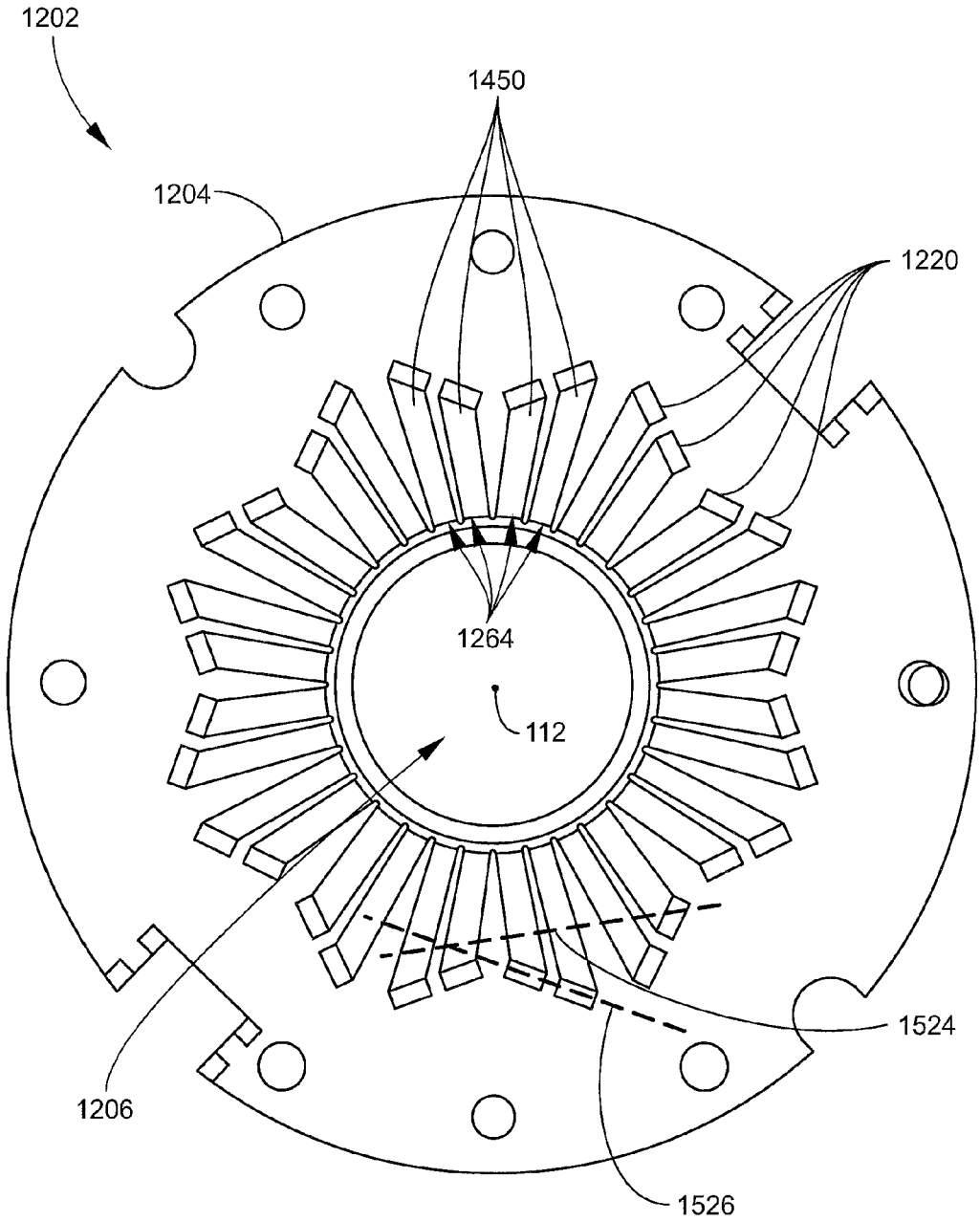
FIG. 15 is a plan view of the phasing plug illustrated in FIGS. 12-14 from the perspective of the output side.

FIG. 15 is a plan view of the phasing plug 1202 illustrated in FIGS. 12-14 from the perspective of the output side. The pattern of the channels 1450 and the resulting acoustical paths may have the same or analogous attributes as those described above regarding the entrances 1220. For example, the orientation of each channel 1450 and associated acoustical path may be non-radial relative to the central axis 112. In another aspect, the entrances 1220 may be non-parallel with (and not radially aligned with) the exits 1264. In another aspect, the lengths of one or more channels 1450 may differ from the lengths of the other channels 1450. The pattern of entrances 1220 and channels 1450 as a whole may be symmetrical relative to the central axis 112 as in the illustrated example, or alternatively may be non-symmetric. In another aspect, for one or more of the channels 1450, the channel 1450 may be oriented at an angle relative to the corresponding entrance 1220, as illustrated in FIG. 15 by a line 1524 passing through the main cross-sectional area (projecting outwardly from the corresponding exit 1264) of a representative channel 1450 and a line 1526 passing through the cross-sectional area of its corresponding entrance 1220.

Figure 16:
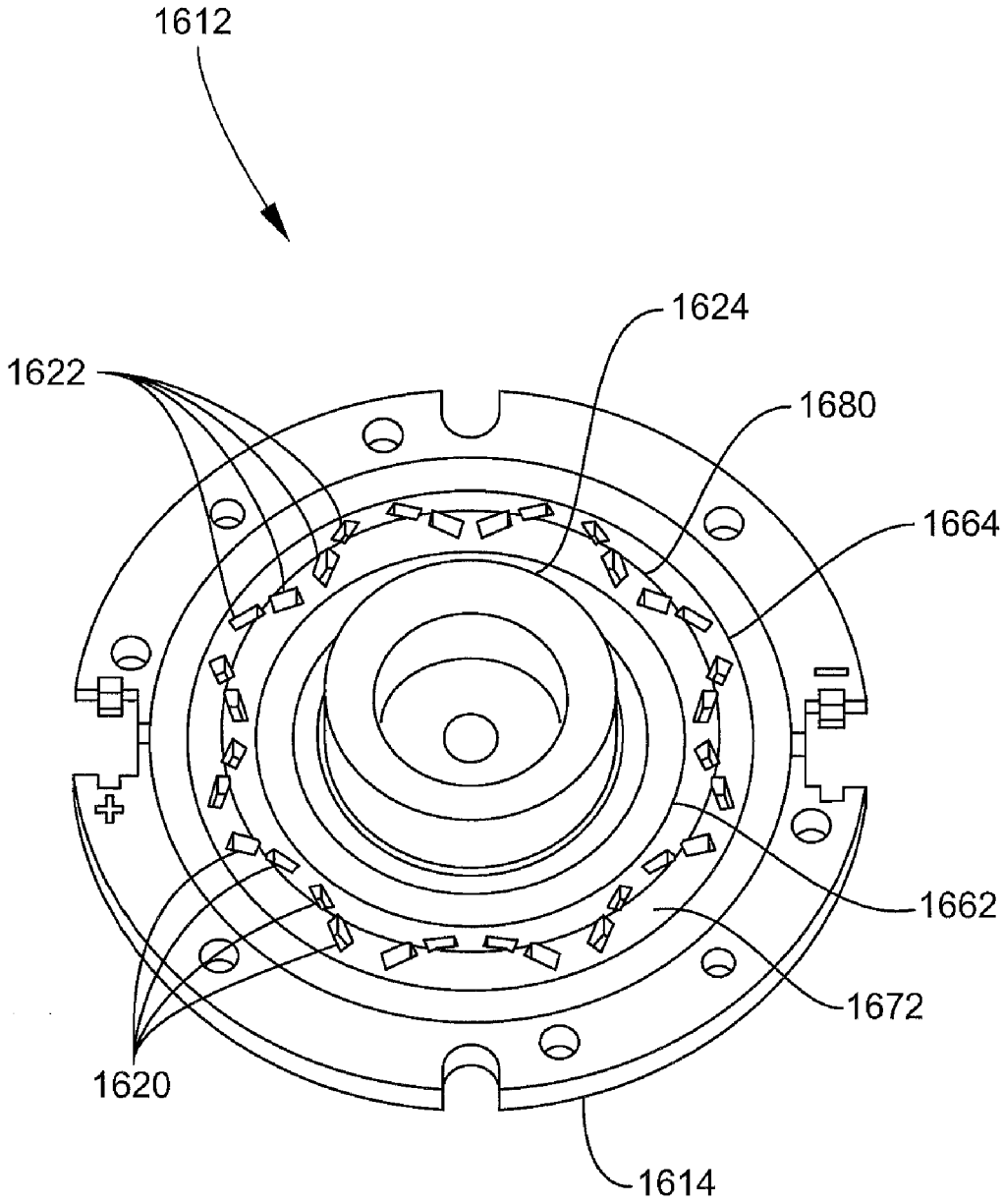
FIG. 16 is a perspective view of an example of a phasing plug from an input side, which may, for example, be utilized as a rear phasing plug in the dual compression driver illustrated in FIGS. 4 and 5.

FIG. 16 is a perspective view of an example of a phasing plug 1612 that may, for example, be utilized as a rear phasing plug in the dual compression driver 400 (FIGS. 4 and 5) in conjunction with the front phasing plug 1202 described above and illustrated in FIGS. 12-15. The perspective is from an input side that would face the rear diaphragm 240 of the dual compression driver 400. The phasing plug 1612 includes a base portion 1614 and may also include a mounting feature 1624 concentric with the central axis. The base portion 1614 includes an annular compression region 1672 located so as to be above (from the perspective of FIGS. 2-5) the movable portion of the rear diaphragm 240. As noted above, the compression region 1672 may have a raised profile (e.g., V-shape or other shape), which in FIG. 16 is generally demarcated by an inner circle 1662, an outer circle 1664 and a circular apex 1680. A plurality of acoustical entrances 1620 is located on the input side in the compression region 1672. The entrances 1620 extend as channels (not shown, but see FIG. 17) through the thickness of the base portion 1614 to acoustical exits located on the output side, thus establishing acoustical paths as described above. The entrances 1620 may have any suitable shapes. In the illustrated example, the entrances 1620 are shaped as slots. The plurality of entrances 1620 may be arranged according to a desired pattern. For this purpose, the plurality of entrances 1620 may be arranged into groups or sets of similarly oriented entrances 1620. In some implementations as in the illustrated example, particularly when the rear phasing plug 1612 is to be disposed in direct abutment with the front phasing plug 1202, the pattern of entrances 1620 of the rear phasing plug 1612 matches and is axially aligned with the pattern of entrances 1220 of the front phasing plug 1202. Hence, in the illustrated example sixteen groups are provided with each group including two entrances 1620.

The total number of entrances 1620 and the cross-sectional areas of the entrances 1620 may be selected according to the compression ratio desired for a particular application.

Particularly in matching implementations, the plurality of entrances 1620 of the rear phasing plug 1612 may be patterned so as to have one or more of the same attributes as described above in conjunction with the entrances 1220 of the front phasing plug 1202. Thus, the orientation of each entrance 1620 may be non-radial relative to the central axis. The entrances 1620 may be arranged along one or more lines (such as lines coincident with the outermost edges 1622) that run diagonally across the annular compression region 1672. The entrances 1620 may lay on the perimeter of a closed polygon associated with a plane in which the base portion 1614 resides, such as the eight-pointed star illustrated in FIGS. 12-15.

Figure 17:
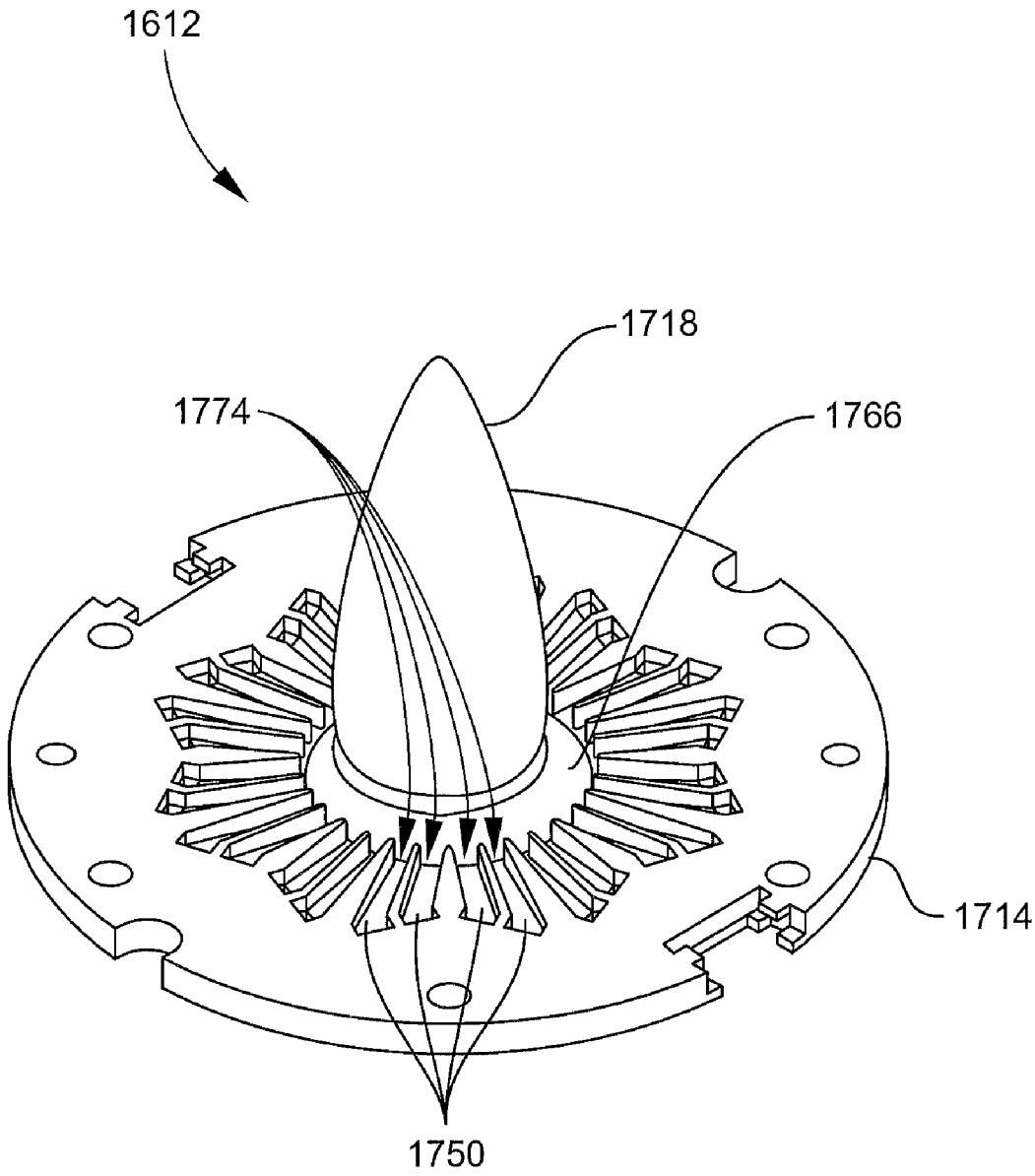
FIG. 17 is another perspective view of the phasing plug illustrated in FIG. 16 from an output side opposite to the input side.

FIG. 17 is another perspective view of the phasing plug 1612 illustrated in FIG. 16 from an output side opposite to the input side. A plurality of channels or grooves 1750 is formed on the output side. The channels 1750 respectively interconnect the entrances 1620 with corresponding exits 1774. The phasing plug 1612 further includes a centrally located hub portion 1718 that may be shaped as a bullet as described above. An annular region 1766 is defined between the hub portion 1718 and the surrounding exits 1774. Accordingly, each acoustical path runs from the compression chamber on the input side, into one of the entrances 1620, through the thickness of the base portion 1614 to the corresponding channel 1750 communicating with that entrance 1620, through the corresponding exit 1774 on the output side, and into the annular region 1766. The channels 1750 may be configured in the same manner as illustrated in FIGS. 14 and 15. In implementations in which the rear phasing plug 1612 directly abuts the front phasing plug 1202, the channels 1750 of the rear phasing plug 1612 may be in open communication with corresponding channels 1450 of the front phasing plug 1202. In other implementations such as described below, a dividing plate may be positioned to axially separate the channels 1750 of the rear phasing plug 1612 from the channels 1450 of the front phasing plug 1202. The pattern of the channels 1750 and the resulting acoustical paths may have the same or analogous attributes as those described above regarding the front phasing plug 1202. For example, the orientation of each channel 1750 and associated acoustical path may be non-radial relative to the central axis. The entrances 1620 may be non-parallel with (and not radially aligned with) the corresponding exits 1774. The lengths of one or more channels 1750 may differ from the lengths of the other channels 1750. The pattern of channels 1750 may or may not be symmetrical relative to the central axis.

Figure 18:
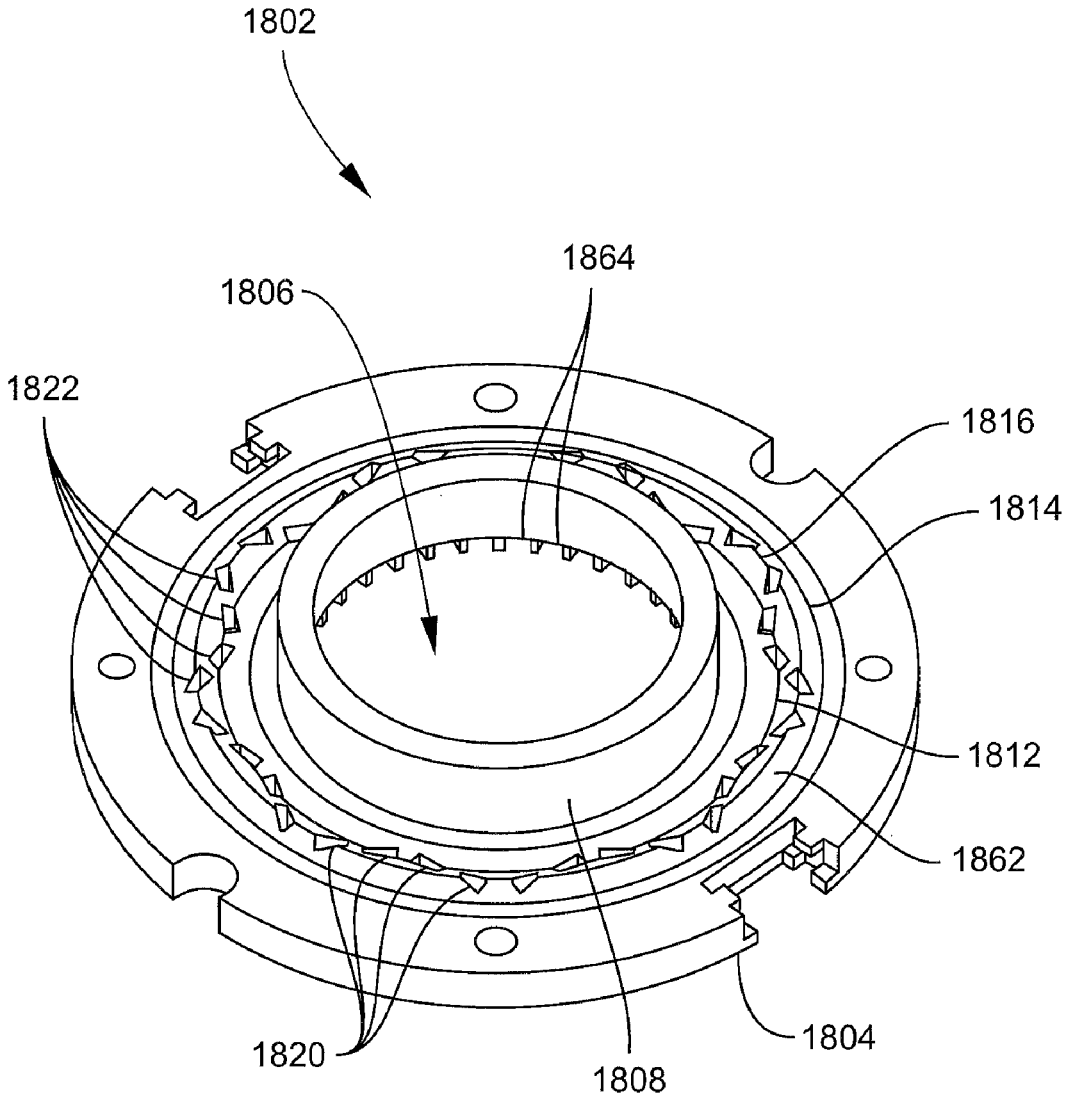
FIG. 18 is a perspective view of another example of a phasing plug from an input side, which may, for example, be utilized as a front phasing plug in the dual compression driver illustrated in FIGS. 4 and 5.

FIG. 18 is a perspective view of another example of a phasing plug 1802 that may, for example, be utilized as a front phasing plug in the dual compression driver 400 (FIGS. 4 and 5). The perspective is from an input side that would face the front diaphragm 230 of the dual compression driver 400. The phasing plug 1802 includes a base portion 1804, a central bore 1806, and a conduit 1808 aligned with the central bore 1806. The base portion 1804 includes an annular compression region 1862 located so as to be underneath the movable portion of the front diaphragm 230. As noted above, the compression region 1862 may have a raised profile (e.g., V-shape or other shape), which in FIG. 18 is generally demarcated by an inner circle 1812, an outer circle 1814, and a circular apex 1816. A plurality of acoustical entrances 1820 is located on the input side in the compression region 1862. The entrances 1820 extend as channels (not shown, but see FIG. 20) through the thickness of the base portion 1804 to acoustical exits 1864 located on the output side, thus establishing acoustical paths as described above. The entrances 1820 may have any suitable shapes. In the illustrated example, the entrances 1820 are shaped as slots with straight edges, including outermost edges 1822. The plurality of entrances 1820 may be arranged according to a desired pattern. For this purpose, the plurality of entrances 1820 may be arranged into groups or sets of similarly oriented entrances 1820. In the illustrated example, eighteen groups are provided with each group including two entrances 1820. The total number of entrances 1820 and the cross-sectional areas of the entrances 1820 may be selected according to the compression ratio desired for a particular application.

Figure 19:
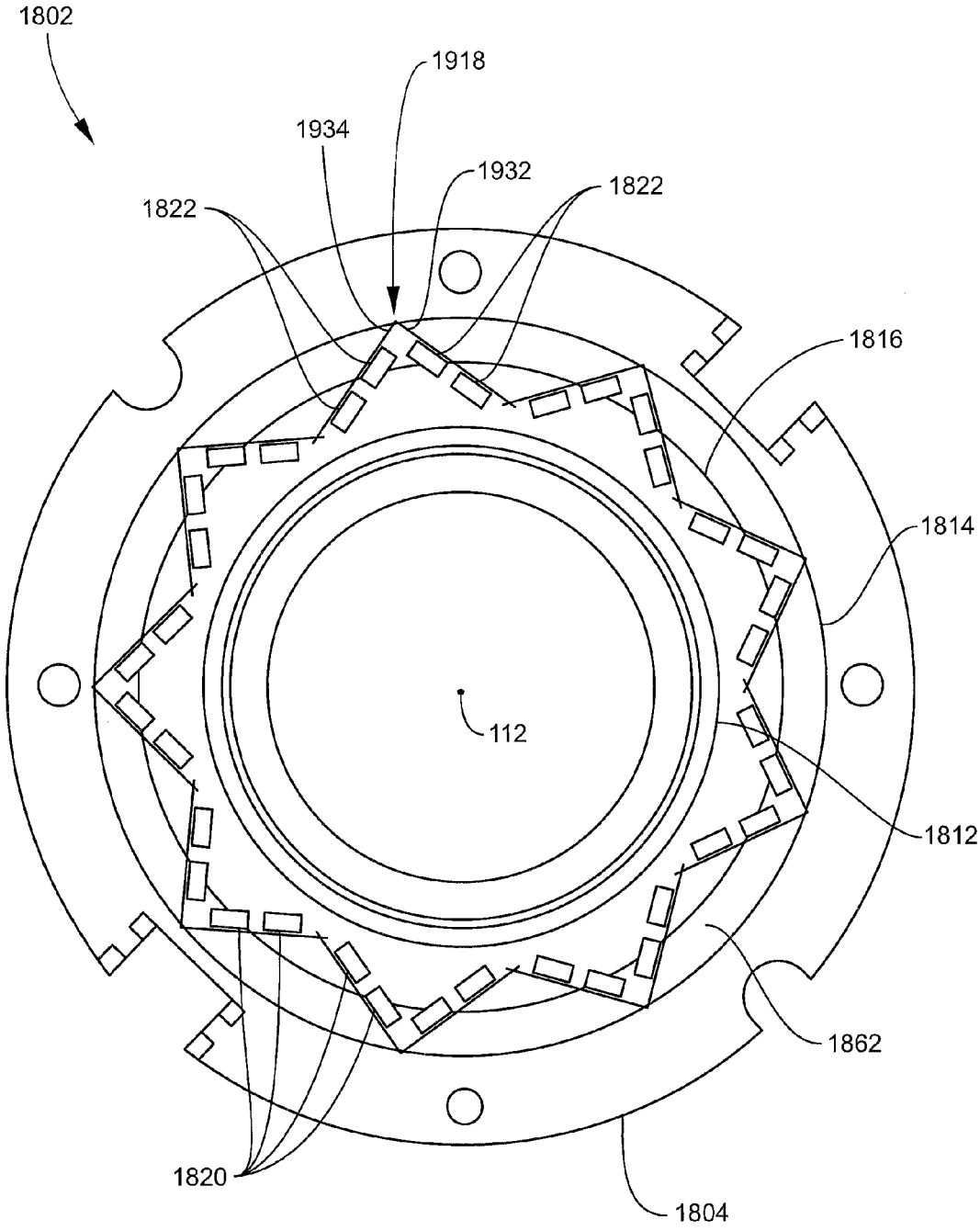
FIG. 19 is a plan view of the phasing plug illustrated in FIG. 18 from the perspective of the input side.

FIG. 19 is a plan view of the phasing plug 1802 illustrated in FIG. 18 from the perspective of the input side. The plurality of entrances 1820 may be patterned so as to have one or more of the same or analogous attributes as described above in conjunction with the implementation illustrated in FIGS. 6-11 or FIGS. 12-17. As examples, the orientation of each entrance 1820 may be non-radial and non-circumferential relative to the central axis 112. Despite the non-radial configuration, however, the pattern of entrances as a whole may be symmetrical relative to the central axis 112, as in the illustrated example. In another aspect, the entrances 1820 may be arranged along one or more lines that run diagonally across the annular compression region 1862. In FIG. 19, this configuration is illustrated by a line 1932 coincident with the outermost edges 1822 of one representative pair of entrances 1820, and a line 1934 coincident with the outermost edges 1822 of a neighboring pair of entrances 1820. The two lines 1932, 1934 intersect at a vertex 1918, and this pattern may be repeated for the other entrances 1820 to form a closed perimeter. The lines 1932, 1934 may be straight or arcuate (concave or convex). In the illustrated example, each group of two entrances 1820 cuts diagonally across the compression region 1862, such as along one diagonal direction (e.g., line 1932) or another diagonal direction (e.g., 1934). In another aspect, the entrances 1820 may be arranged along one or more lines that are diagonal relative to the central axis 112. A diagonal line may or may not be tangential to a circle concentric with the central axis 112. In another aspect, the entrances 1820 may lay on the perimeter of a closed polygon associated with a plane in which the base portion 1804 resides. In the illustrated example, the closed polygon has nine vertices such as vertex 1918. In the illustrated example, as represented in part by the lines 1932, 1934, the entrances 1820 lay on the perimeter of a nine-pointed star. Alternatively, the vertices may be considered as being the corners of a polygon. Hence, in the illustrated example the nine-pointed star may be considered as being inscribed by a nonagon.

Figure 20:
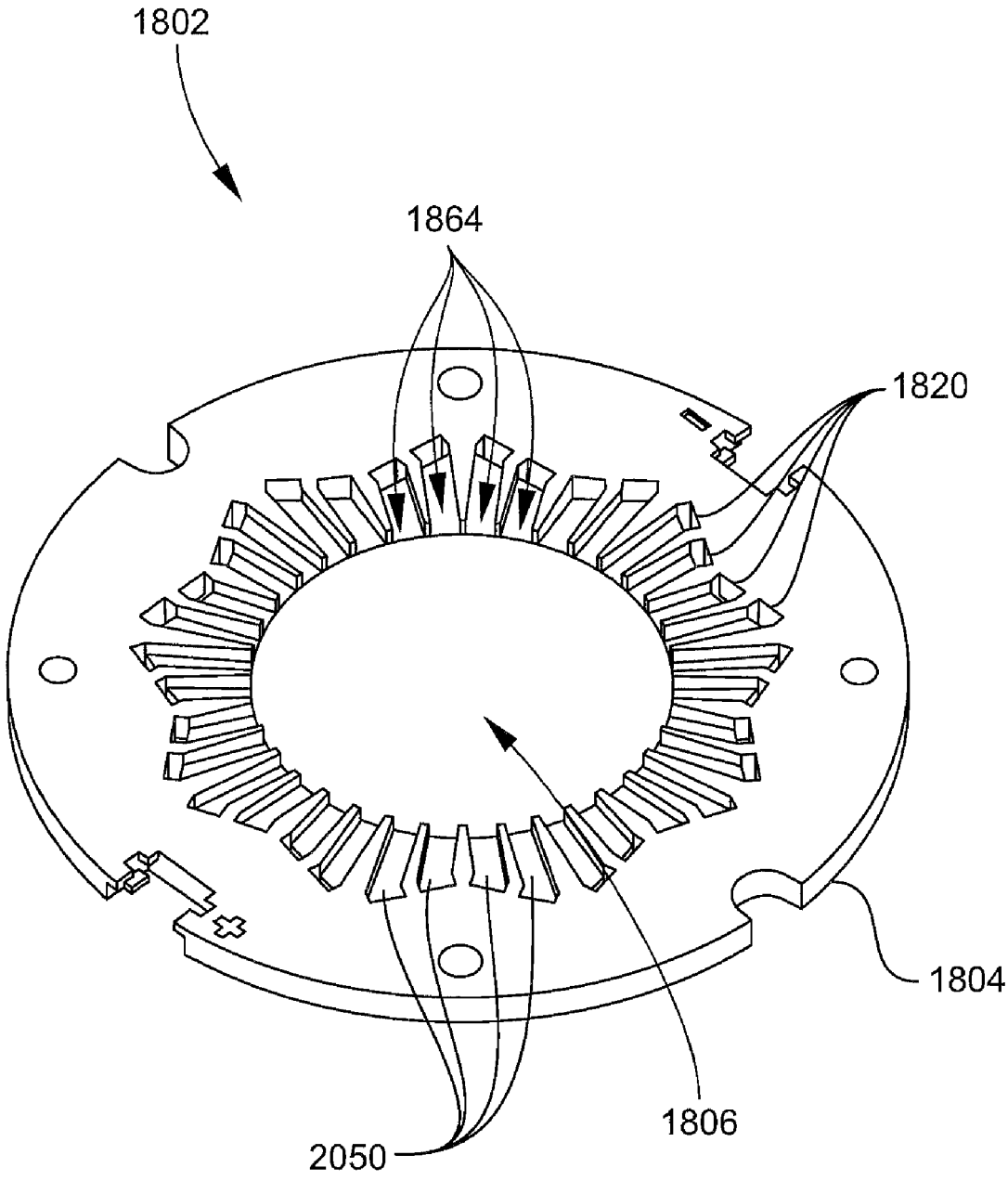
FIG. 20 is another perspective view of the phasing plug illustrated in FIGS. 18 and 19 from an output side opposite to the input side.

FIG. 20 is another perspective view of the phasing plug 1802 illustrated in FIGS. 18 and 19 from an output side opposite to the input side. A plurality of channels or grooves 2050 is formed on the output side. The channels 2050 respectively interconnect the entrances 1820 with corresponding exits 1864. Accordingly, each acoustical path runs from the compression chamber on the input side, into one of the entrances 1820, through the thickness of the base portion 1804 to the corresponding channel 2050 communicating with that entrance 1820, through the corresponding exit 1864 on the output side, and into the central bore 1806.

Figure 21:
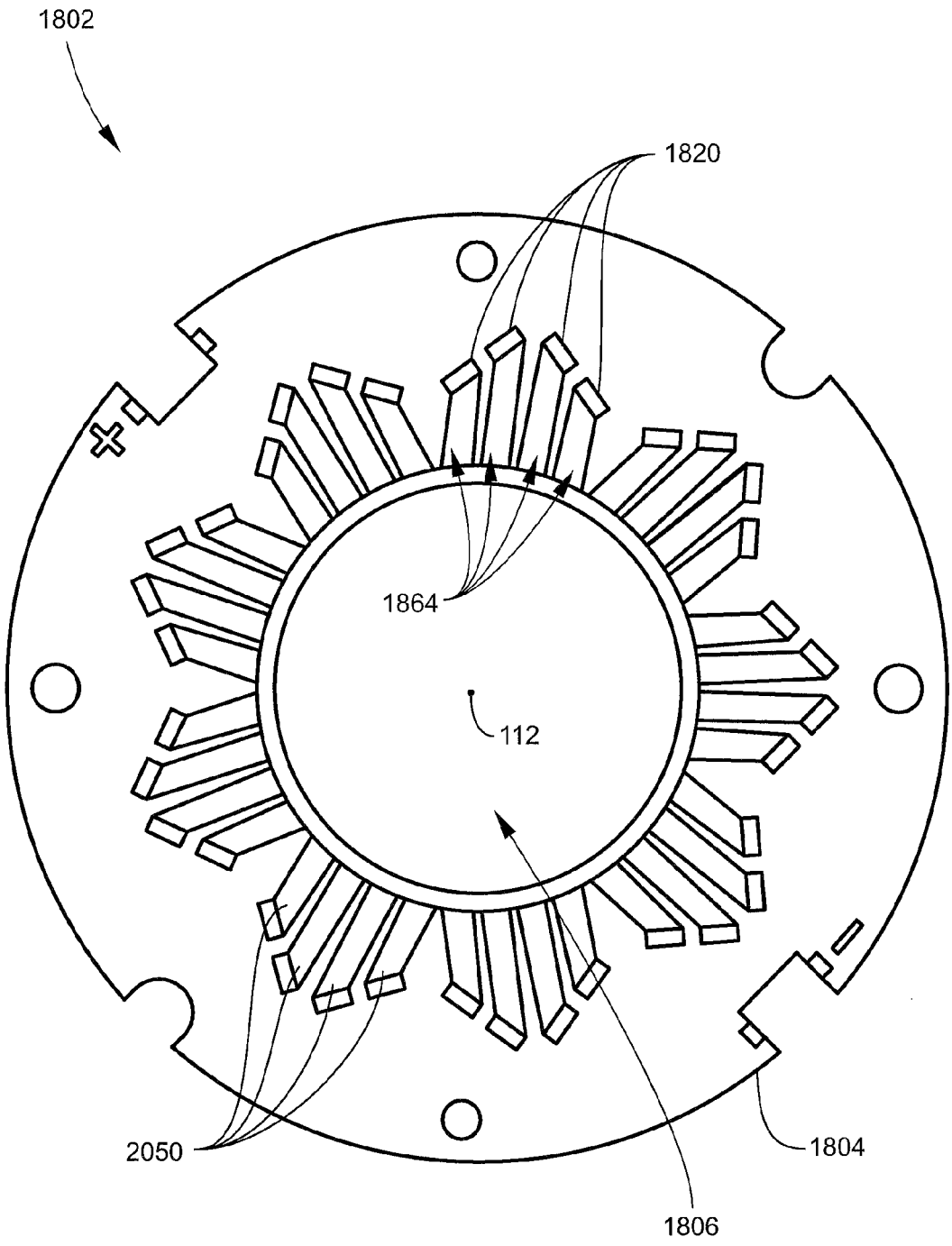
FIG. 21 is a plan view of the phasing plug illustrated in FIGS. 18-20 from the perspective of the output side.

FIG. 21 is a plan view of the phasing plug 1802 illustrated in FIGS. 18-20 from the perspective of the output side. The pattern of the channels 2050 and the resulting acoustical paths may have the same or analogous attributes as those described above regarding the entrances 1820. For example, the orientation of each channel 2050 and associated acoustical path may be non-radial relative to the central axis 112. The entrances 1820 may be non-parallel with (and not radially aligned with) the corresponding exits 1864. The lengths of one or more channels 2050 may differ from the lengths of the other channels 2050. The pattern of entrances 1820 and channels 2050 as a whole may be symmetrical relative to the central axis 112 as in the illustrated example, or alternatively may be non-symmetric. For one or more of the channels 2050, the channel 2050 may be oriented at an angle relative to the corresponding entrance 1820.

Figure 22:
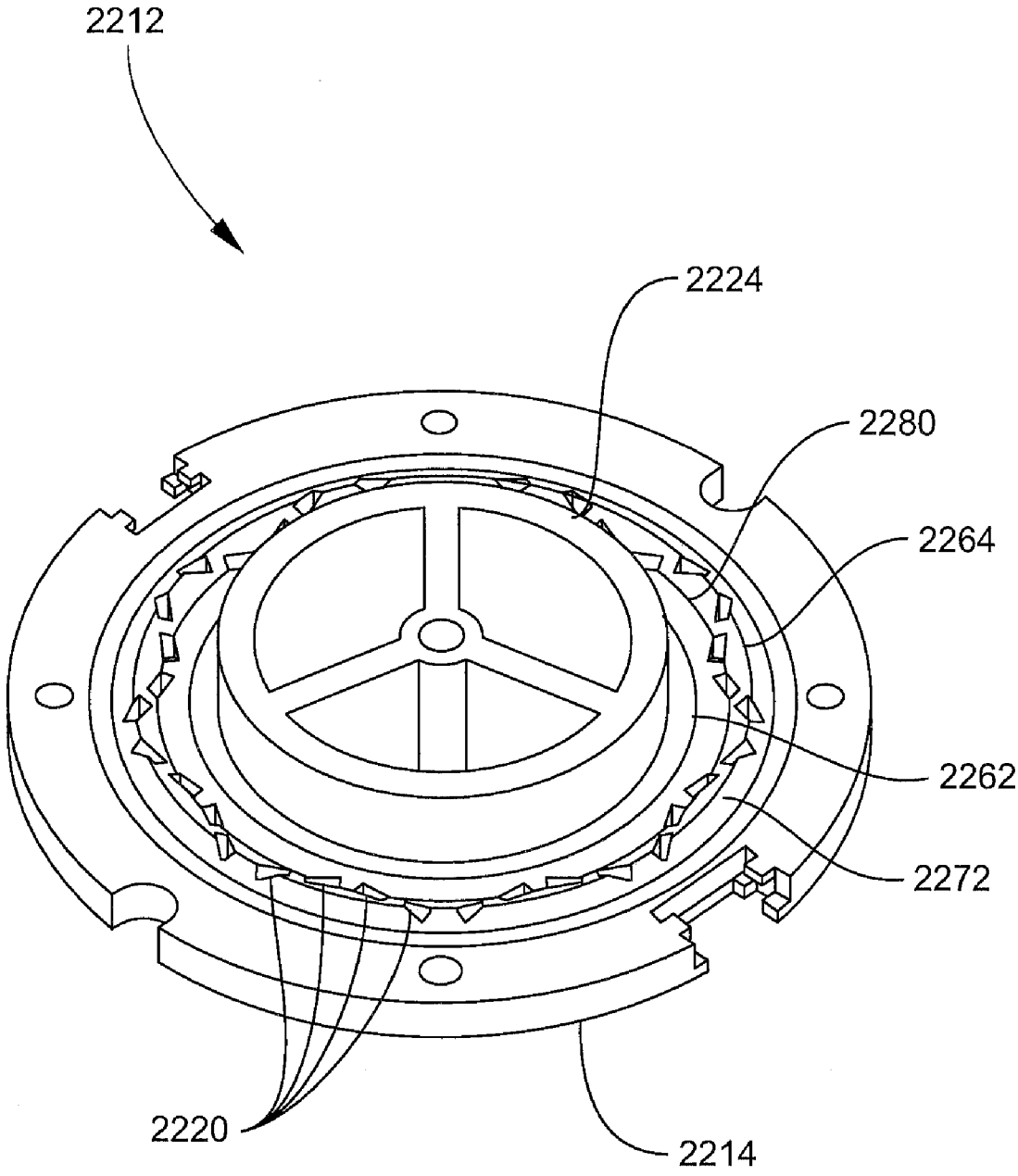
FIG. 22 is a perspective view of an example of a phasing plug from an input side, which may, for example, be utilized as a rear phasing plug in the dual compression driver illustrated in FIGS. 4 and 5.

FIG. 22 is a perspective view of an example of a phasing plug 2212 that may, for example, be utilized as a rear phasing plug in the dual compression driver 400 (FIGS. 4 and 5) in conjunction with the front phasing plug 1802 described above and illustrated in FIGS. 18-21. The perspective is from an input side that would face the rear diaphragm 240 of the dual compression driver 400. The phasing plug 2212 includes a base portion 2214 and may also include mounting feature 2224 concentric with the central axis. The base portion 2214 includes an annular compression region 2272 located so as to be above (from the perspective of FIGS. 2-5) the movable portion of the rear diaphragm 240. As noted above, the compression region 2272 may have a raised profile (e.g., V-shape or other shape), which in FIG. 22 is generally demarcated by an inner circle 2262, an outer circle 2264, and a circular apex 2280. A plurality of acoustical entrances 2220 is located on the input side in the compression region 2272. The entrances 2220 extend as channels (not shown, but see FIG. 23) through the thickness of the base portion 2214 to acoustical exits located on the output side, thus establishing acoustical paths as described above. The entrances 2220 may have any suitable shapes. In the illustrated example, the entrances 2220 are shaped as slots. The plurality of entrances 2220 may be arranged according to a desired pattern. For this purpose, the plurality of entrances 2220 may be arranged into groups or sets of similarly oriented entrances 2220. In some implementations as in the illustrated example, particularly when the rear phasing plug 2212 is to be disposed in direct abutment with the front phasing plug 1802, the pattern of entrances 2220 of the rear phasing plug 2212 matches and is axially aligned with the pattern of entrances 1820 of the front phasing plug 1802. Hence, in the illustrated example eighteen groups are provided with each group including two entrances 2220. The total number of entrances 2220 and the cross-sectional areas of the entrances 2220 may be selected according to the compression ratio desired for a particular application.

Particularly in matching implementations, the plurality of entrances 2220 of the rear phasing plug 2212 may be patterned so as to have one or more of the same attributes as described above in conjunction with the entrances 1820 of the front phasing plug 1802. Thus, the orientation of each entrance 2220 may be non-radial relative to the central axis. The entrances 2220 may be arranged along one or more lines that run diagonally across the annular compression region 2272. The entrances 2220 may lay on the perimeter of a closed polygon associated with a plane in which the base portion 2214 resides, such as the nine-pointed star illustrated in FIG. 19.

Figure 23:
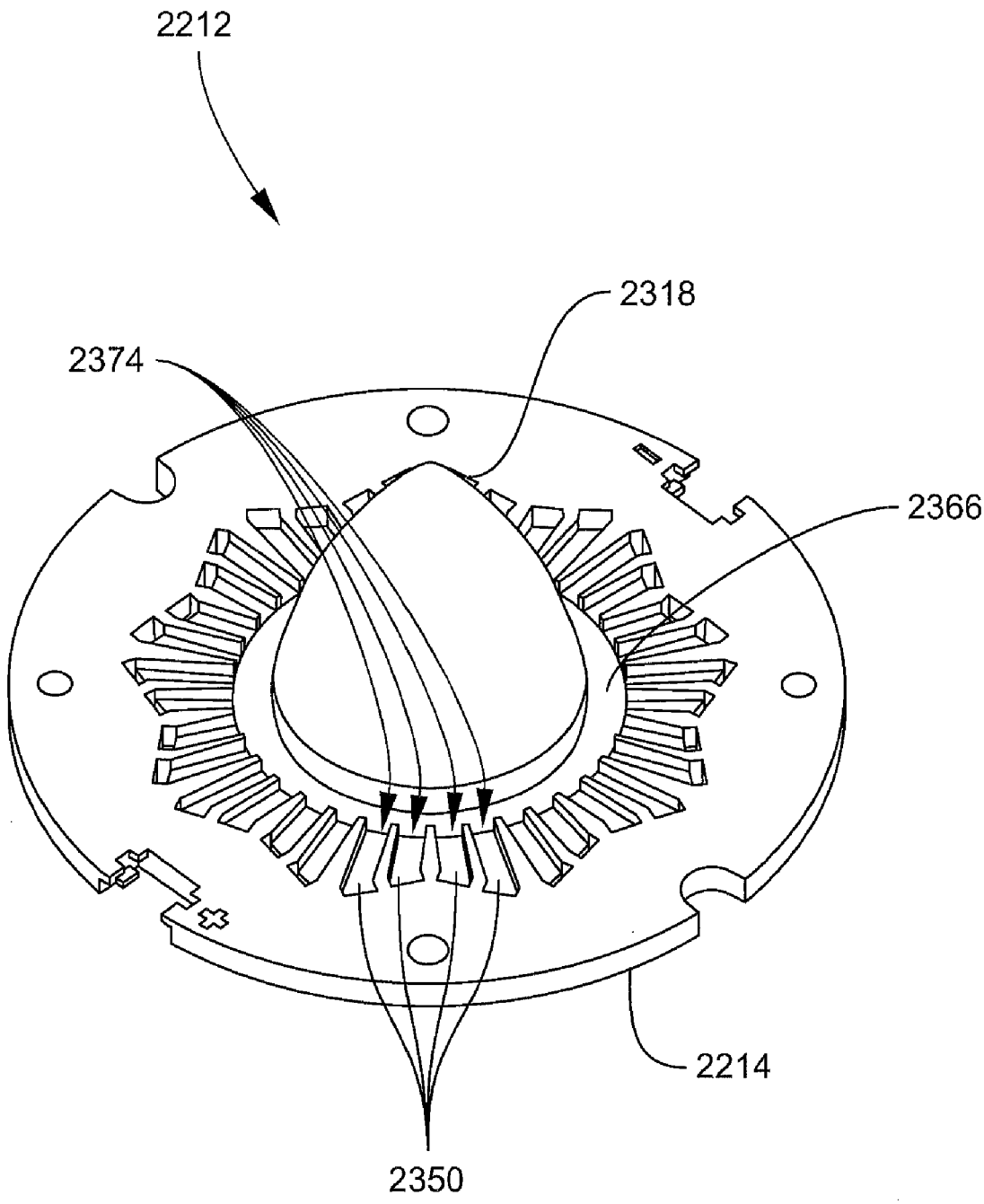
FIG. 23 is another perspective view of the phasing plug illustrated in FIG. 22 from an output side opposite to the input side.

FIG. 23 is another perspective view of the phasing plug 2212 illustrated in FIG. 22 from an output side opposite to the input side. A plurality of channels or grooves 2350 is formed on the output side. The channels 2350 respectively interconnect the entrances 2220 with corresponding exits 2374. The phasing plug 2212 further includes a centrally located hub portion 2318 that may be shaped as a bullet as described above. An annular region 2366 is defined between the hub portion 2318 and the surrounding exits 2374. Accordingly, each acoustical path runs from the compression chamber on the input side, into one of the entrances 2220, through the thickness of the base portion 2214 to the corresponding channel 2350 communicating with that entrance 2220, through the corresponding exit 2374 on the output side, and into the annular region 2366. The channels 2350 may be configured in the same manner as illustrated in FIGS. 20 and 21. In implementations in which the rear phasing plug 2212 directly abuts the front phasing plug 1802, the channels 2350 of the rear phasing plug 2212 may be in open communication with corresponding channels 1820 of the front phasing plug 1802. In other implementations such as described below, a dividing plate may be positioned to axially separate the channels 2350 of the rear phasing plug 2212 from the channels 2050 of the front phasing plug 1802. The pattern of the channels 2350 and the resulting acoustical paths may have the same or analogous attributes as those described above regarding the front phasing plug 1802. For example, the orientation of each channel 2350 and associated acoustical path may be non-radial relative to the central axis. The entrances 2220 may be non-parallel with (and not radially aligned with) the corresponding exits 2374. The lengths of one or more channels 2350 may differ from the lengths of the other channels 2350. The pattern of channels 2350 may or may not be symmetrical relative to the central axis.

A particular pattern of entrances and channels provided by a dual phasing plug assembly in accordance with the present teachings may be found to be appropriate or optimal based on one or more performance-related requirements and/or or design constraints associated with a given transducer, such as size, frequency response, etc. As a non-limiting example, at present the phasing plug set illustrated in FIGS. 6-11 is contemplated for a 1.5-inch voice coil format diaphragm, the phasing plug set illustrated in FIGS. 12-17 is contemplated for a 2-inch voice coil format diaphragm, and the phasing plug set illustrated in FIGS. 18-23 is contemplated for a 3-inch voice coil format diaphragm. More generally, however, any of the patterns encompassed by the present teachings may be scaled to any size practical for transducers having compression chambers.

Figure 24:
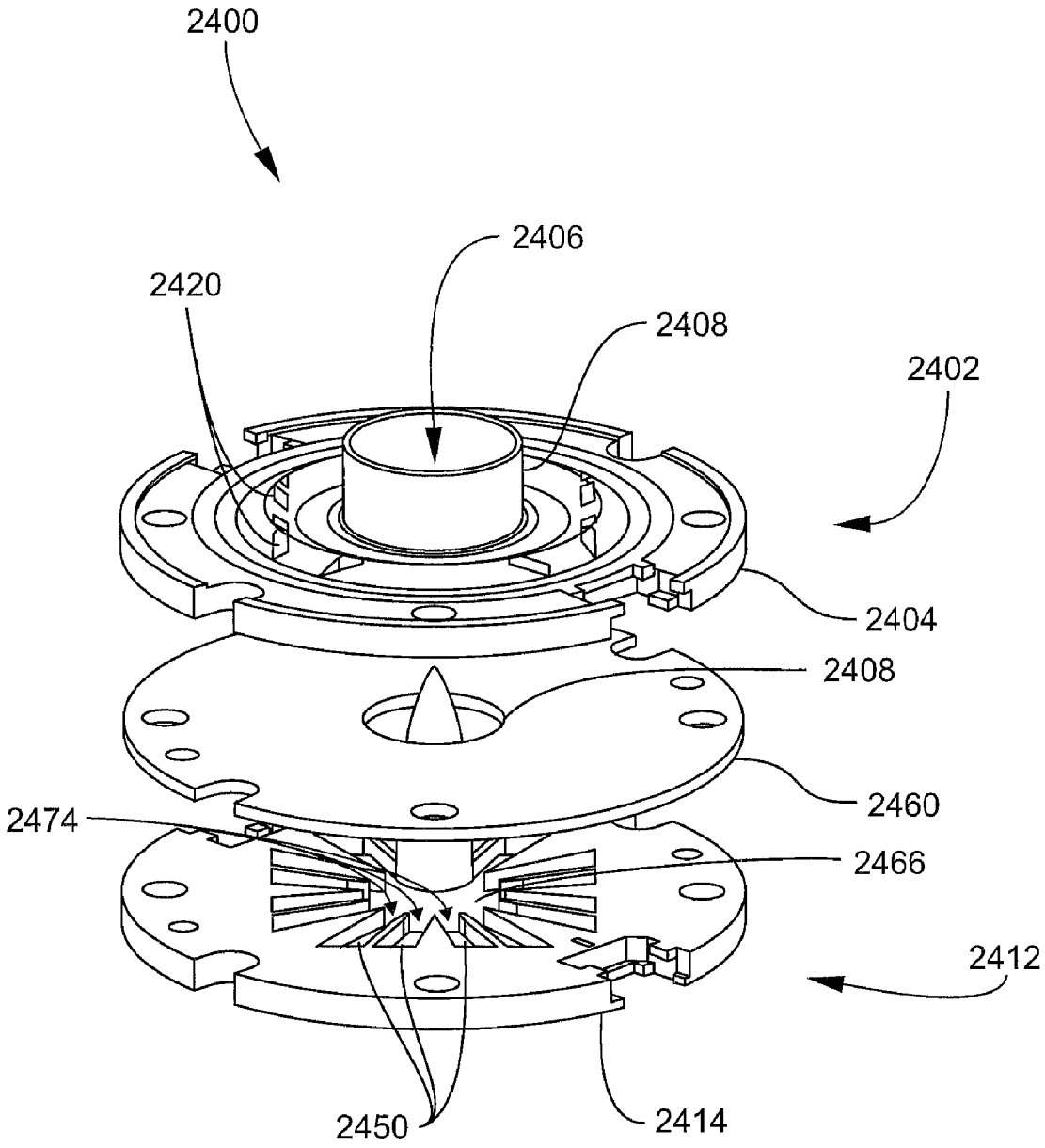
FIG. 24 is an exploded perspective view of another example of a dual phasing plug assembly that may be provided as part of a dual compression driver such as illustrated in FIGS. 4 and 5.

FIG. 24 is an exploded perspective view of another example of a dual phasing plug assembly 2400. The dual phasing plug assembly 2400 may be provided, for example, as part of the dual compression driver 400 (FIGS. 4 and 5), which in turn may be provided, for example, as part of the transducer section 104 (FIG. 1) of the loudspeaker 100. The dual phasing plug assembly 2400 includes a front phasing plug 2402. The front phasing plug 2402 includes a front base portion 2404 and a central bore 2406. The front phasing plug 2402 may also include a conduit 2408 axially extending from the central bore 2406. The front phasing plug 2402 includes a pattern of entrances 2420, channels (not shown) and exits (not shown), which may be configured in accordance with any of the examples described above and illustrated in FIGS. 6-23. The dual phasing plug assembly 2400 also includes a rear phasing plug 2412. The rear phasing plug 2412 includes a rear base portion 2414 and a hub portion 2418 such as a bullet that extends through the central bore 2406 (and through the conduit 2408, if provided) when the dual phasing plug assembly 2400 is assembled. The rear phasing plug 2412 includes a pattern of entrances (not shown), channels 2450 and exits 2474, which may be configured in accordance with any of the examples described above and illustrated in FIGS. 6-23. An annular region 2466 is defined generally between the exits 2474 and the hub portion 2418.

Additionally, the dual phasing plug assembly 2400 includes a dividing plate (or divider) 2460 axially interposed between the respective output sides of the front phasing plug 2402 and the rear phasing plug 2412. The dividing plate 2460 is sized large enough to cover the channels (not shown) of the front phasing plug 2402 and the channels 2450 of the rear phasing plug 2412, and serves as a partition between the front channels and the rear channels 2450. Hence, in the present implementation the front acoustical paths do not merge or sum with each other until they reach the annular region 2466. The dividing plate 2460 includes a central aperture 2408 through which the hub portion 2418 extends and through which the acoustical signals outputted from the rear phasing plug 2412 pass. The dividing plate 2460 changes the acoustical impedance of the of the acoustical connectors (i.e. entrances, channels, exits) of the dual phasing plug assembly 2400, and may be utilized as a means for fine tuning the overall frequency response of the dual phasing plug assembly 2400. The diameter of the central aperture 2408 may be varied to provide extra flexibility in the fine tuning of the acoustical impedance of the acoustical connectors and, correspondingly, in the fine tuning of the frequency response. Accordingly, the diameter of the central aperture 2408 may be different from the diameter of the central bore 2406. The dividing plate 2460 may also provide more flexibility in the design of the dual phasing plug assembly 2400. For example, the dividing plate 2460 facilitates the use of respective entrance/channel patterns of the front phasing plug 2402 and rear phasing plug 2412 that are not necessarily matched to each other (i.e., are not mirror images of each other). Consequently, the dividing plate 2460 enables the provision of time-alignment or specific delay and corresponding phase shift in one of the phasing plugs 2402, 2412 to vary and optimize high-frequency response. An example of implementing this feature is described below in conjunction with FIGS. 25 and 26.

Figure 25:
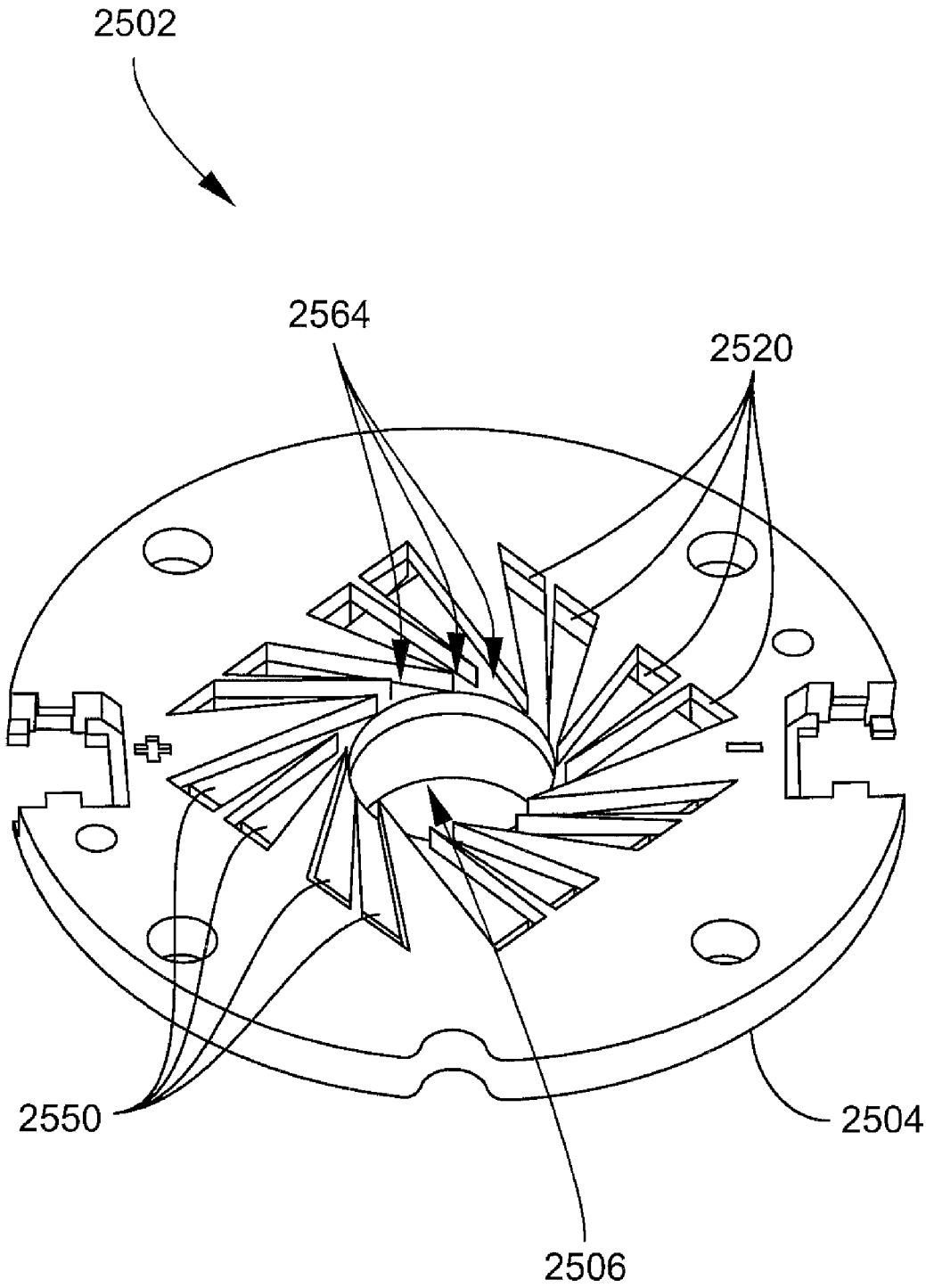
FIG. 25 is a perspective view of another example of a phasing plug, specifically from the perspective of its output side.

FIG. 25 is a perspective view of another example of a phasing plug 2502, specifically from the perspective of its output side. The phasing plug 2502 includes a base portion 2504 in which entrances 2520, channels 2550, and exits 2564 are formed. The phasing plug 2502 in this example is a front phasing plug that includes a central bore 2506 such that the exits 2564 are located at the perimeter of the central bore 2506. In this example, the entrance/channel pattern is generally similar to that illustrated in FIG. 8. However, the lengths of the channels 2550 have been increased by changing the angles of the channels 2550 (relative to any reference line, such as a radius of the base portion 2504). As a result, the channels 2550 (and hence the path lengths through the channels 2550) are extended in comparison to those of FIG. 8, which equalizes the time delay.

Figure 26:
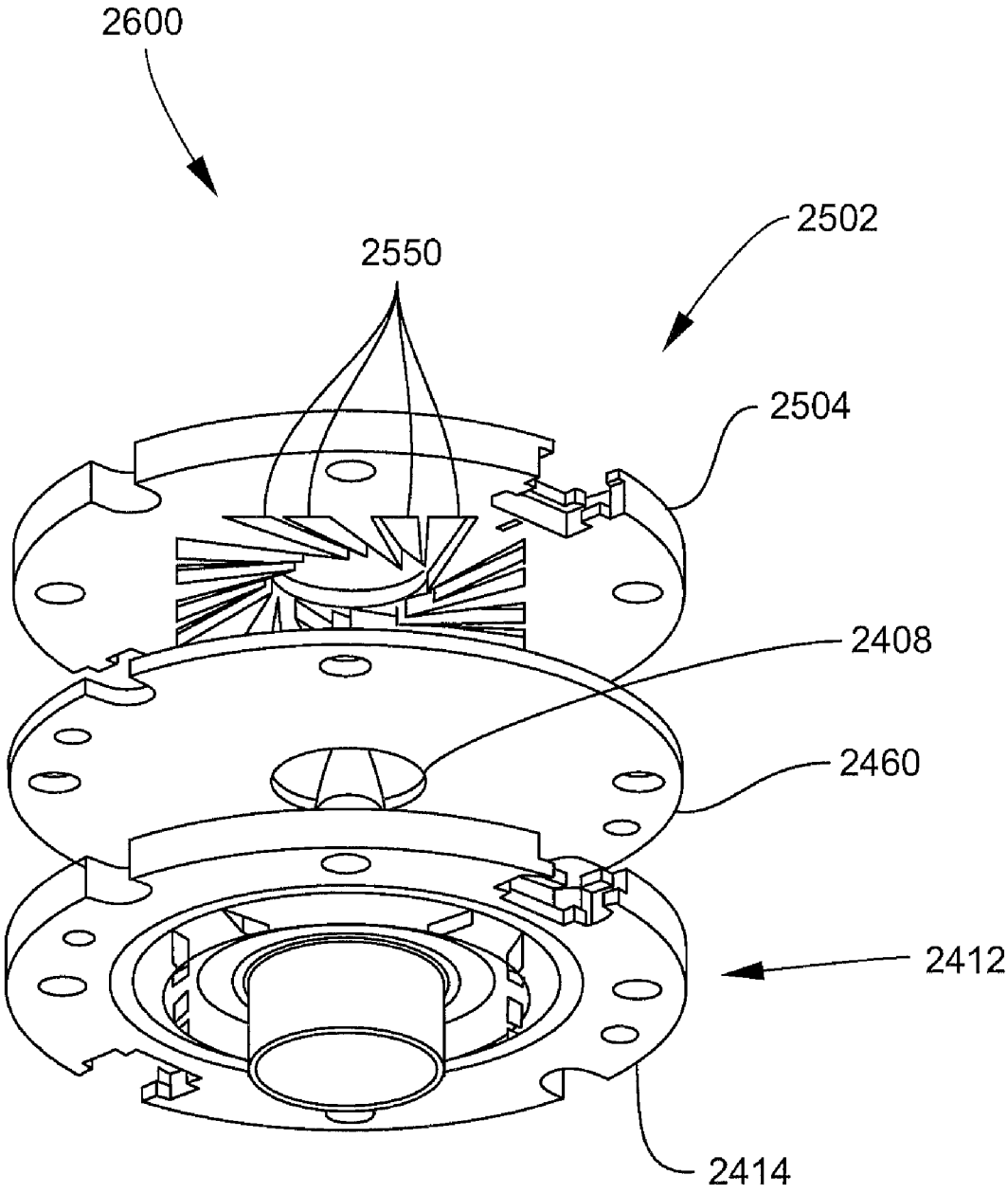
FIG. 26 is an exploded perspective view of another example of a dual phasing plug assembly in which the phasing plug illustrated in FIG. 25 is utilized as a front phasing plug.

FIG. 26 is an exploded perspective view of another example of a dual phasing plug assembly 2600. The dual phasing plug assembly 2600 includes the front phasing plug 2502 illustrated in FIG. 25 that features the extended-length channels 2550, a rear phasing plug such as the rear phasing plug 2412 illustrated in FIG. 24, and the intervening dividing plate 2460 illustrated in FIG. 24. FIG. 26 is an example of providing different respective patterns in the front phasing plug 2502 and the rear phasing plug 2412 to obtain a desired acoustical effect. In the present example, the pattern of the front phasing plug 2502 is configured to provide time alignment as described above.

In other implementations, any of the front or rear phasing plugs described above and illustrated in FIGS. 2-26 may be utilized individually in a single compression driver.

Figure 27:
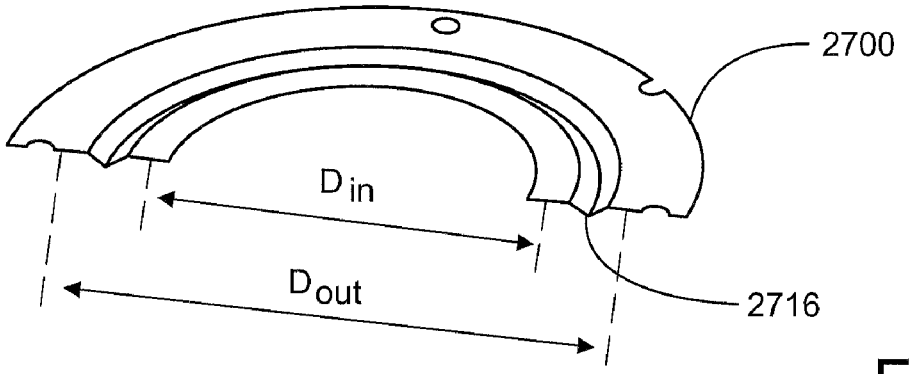
FIG. 27 is a cross-sectional perspective view of a diaphragm having a V-shaped profile.
Figure 28:
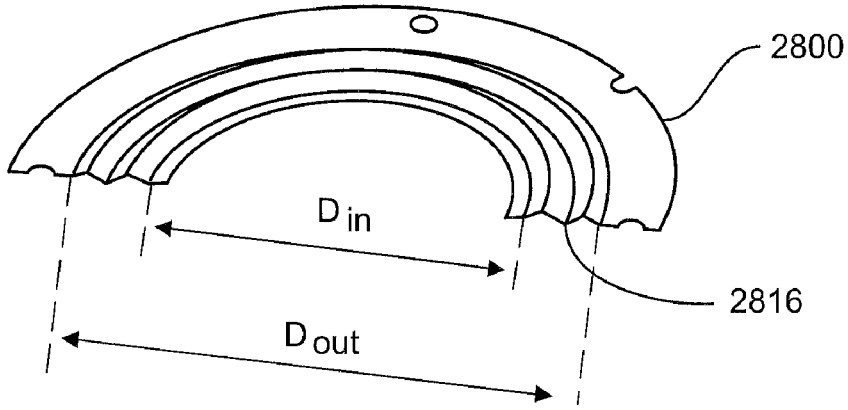
FIG. 28 is a cross-sectional perspective view of a diaphragm having an M-shaped profile.
Figure 29:
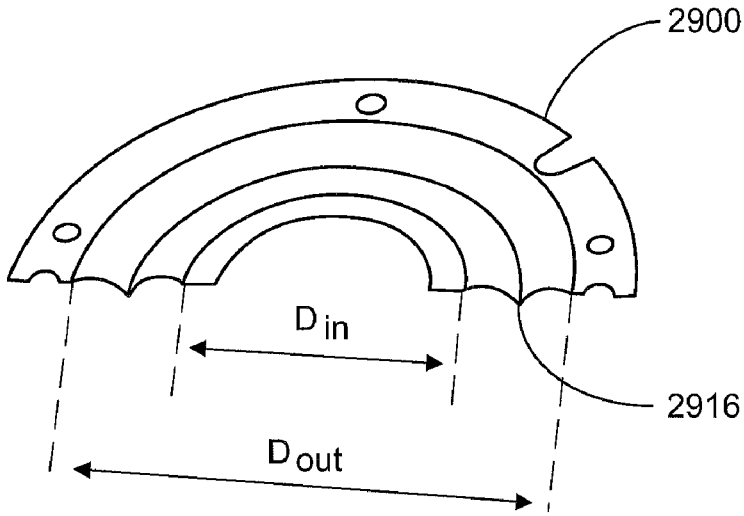
FIG. 29 is a cross-sectional perspective view of a diaphragm having a dual-roll profile.

As noted above, diaphragms of various configurations may be utilized in the implementations taught in the present disclosure. As examples, FIG. 27 is a cross-sectional perspective view of a diaphragm 2700 having a V-shaped profile, FIG. 28 is a cross-sectional perspective view of a diaphragm 2800 having an M-shaped profile, and FIG. 29 is a cross-sectional perspective view of a diaphragm 2900 having a dual-roll profile. The diaphragms 2700, 2800, 2900 have respective annular apices 2716, 2816, 2916 at which voice coil assemblies may be attached. As described above, the surface of a phasing plug utilized to form a compression chamber with the diaphragm may include a raised profile that is complementary (V-shaped, M-shaped, dual-roll, half-roll, etc.) to that of the diaphragm. In each of FIGS. 27-29, $D_{in}$ is the internal clamping diameter and $p_{out}$ is the external clamping diameter. The clamping diameters may be determined by the means utilized to clamp or otherwise fix the diaphragm in a final-assembly position, such as for example by positioning rings 232, 234, 242, 244 (FIGS. 2-5).

The implementations described by example above offer significant flexibility in the specification of compression drivers for desired applications and frequency ranges in sound production. The compression ratio may be controlled by changing the geometry and dimensions of the acoustical connectors formed in the phasing plugs while, at the same time, preserving the continuity of the area of expansion defined by the waveguide of the phasing plug assembly. The patterns exhibited by the acoustical connectors may be configured to obtain a desired frequency response and/or optimize other operating parameters. Accordingly, the implementations disclosed herein provide flexible control over efficiency of the compression driver and over the shape of its frequency response.

In general, the term "communicate" (for example, a first component "communicates with" or "is in communication with" a second component) is used in the present disclosure to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A dual phasing plug assembly for a compression driver, the dual phasing plug assembly comprising:

a first phasing plug including:

a first base portion including a first input side, a first output side, a central bore coaxial with a central axis and extending from the first input side to the first output side, a plurality of first entrances on the first input side, a plurality of first exits communicating with the central bore on the first output side, and a plurality of first channels fluidly interconnecting the first entrances with the respective first exits, where each corresponding first entrance, first channel and first exit establish a first acoustical path that is non-radial relative to the central axis; and a second phasing plug including:

a second base portion including a second input side, a second output side facing the first output side, a plurality of second entrances on the second input side, a plurality of second exits on the second output side, and a plurality of second channels fluidly interconnecting the second entrances with the respective second exits, where each corresponding second entrance, second channel and second exit establish a second acoustical path that is non-radial relative to the central axis; and a hub portion extending along the central axis from the second output side through the central bore, the hub portion including an outside surface having a diameter coaxial with the central axis, where the first exits and the second exits communicate with an annular region between the central bore and the outside surface.

2. The dual phasing plug assembly of claim 1, where the outside surface is bullet-shaped and terminates at an apex on the central axis.

3. The dual phasing plug assembly of claim 1, where the first phasing plug includes a conduit extending from the central bore along the central axis away from the first input side, the hub portion extends through the conduit, and the conduit and the outside surface form a waveguide extending from the annular region away from the first input side.

4. The dual phasing plug assembly of claim 1, including a first diaphragm axially spaced from the first input side and forming with the first input side a first compression chamber communicating with the first entrances, and a second diaphragm axially spaced from the second input side and forming with the second input side a second compression chamber communicating with the second entrances.

5. The dual phasing plug assembly of claim 4, where the first diaphragm includes a first raised portion and the first base portion includes a first annular region shaped complementarily with the first raised portion, and the second diaphragm includes a second raised portion and the second base portion includes a second annular region shaped complementarily with the second raised portion.

6. The dual phasing plug assembly of claim 4, including a first voice coil assembly attached to the first diaphragm, and a second voice coil assembly attached to the second diaphragm.

7. The dual phasing plug assembly of claim 1, where the first output side abuts the second output side, and each first exit adjoins a respective second exit forming a common exit at the annular region.

8. The dual phasing plug assembly of claim 1, where the first exits and the second exits are concentric with the central axis.

9. The dual phasing plug assembly of claim 1, where the first entrances are arranged in a first pattern in a plane orthogonal to the longitudinal axis, the second entrances are arranged in a second pattern in a parallel plane, and the first pattern matches the second pattern.

10. The dual phasing plug assembly of claim 1, where each first entrance and each second entrance is arranged along a respective line that is diagonal relative to the central axis.

11. The dual phasing plug assembly of claim 1, where each first entrance has a cross-sectional area non-parallel to a cross-sectional area of the respective first exit, and each second entrance has a cross-sectional area non-parallel to a cross-sectional area of the respective second exit.

12. The dual phasing plug assembly of claim 1, where each first entrance has a cross-sectional area non-parallel to a cross-sectional area of the respective first channel, and each second entrance has a cross-sectional area non-parallel to a cross-sectional area of the respective second channel.

13. The dual phasing plug assembly of claim 1, where at least one first channel has a length different from respective lengths of the other first channels, and at least one second channel has a length different from respective lengths of the other second channels.

14. The dual phasing plug assembly of claim 1, where:

the plurality of first entrances lie along a plurality of lines, and the lines collectively form a first polygon including at least four vertices at which neighboring lines adjoin; and the plurality of second entrances lie along a plurality of lines, and the lines collectively form a second polygon including at least four vertices at which neighboring lines adjoin.

15. The dual phasing plug assembly of claim 14, where:

the plurality of first entrances is grouped into a plurality of sets of at least two first entrances and, for each set, the at least two first entrances lie along the same line; and the plurality of second entrances is grouped into a plurality of sets of at least two second entrances and, for each set, the at least two second entrances lie along the same line.

16. The dual phasing plug assembly of claim 14, where:

the plurality of first entrances is grouped into a plurality of sets of at least four first entrances and, for each set, the at least four first entrances lie along the same line; and the plurality of second entrances is grouped into a plurality of sets of at least four second entrances and, for each set, the at least four second entrances lie along the same line.

17. The dual phasing plug assembly of claim 14, where at least one of the first polygon and the second polygon is a quadrangle.

18. The dual phasing plug assembly of claim 14, where at least one of the first polygon and the second polygon is a star.

19. The dual phasing plug assembly of claim 1, including a dividing plate between the first base portion and the second base portion, the dividing plate including a central aperture through which the hub portion extends, where a first side of the dividing plate closes the first channels and a second side of the dividing plate closes the second channels.

20. The dual phasing plug assembly of claim 19, where the central aperture has a diameter different from a diameter of the central bore.

21. The dual phasing plug assembly of claim 19, where the first channels are arranged in a first pattern in a plane orthogonal to the longitudinal axis, the second channels are arranged in a second pattern in a parallel plane, and the first pattern is different from the second pattern.

22. A dual compression driver, comprising:

a first magnet assembly including an annular first air gap;

a first voice coil assembly axially movable in the first air gap;

a first diaphragm attached to the first voice coil assembly;

a second magnet assembly including an annular second air gap;

a second voice coil assembly axially movable in the second air gap;

a second diaphragm attached to the second voice coil assembly;

a first phasing plug including:

a first base portion including a first input side axially spaced from the first diaphragm to form a first compression chamber, a first output side, a central bore coaxial with a central axis and extending from the first input side to the first output side, a plurality of first entrances on the first input side communicating with the first compression chamber, a plurality of first exits communicating with the central bore on the first output side, and a plurality of first channels fluidly interconnecting the first entrances with the respective first exits, where each corresponding first entrance, first channel and first exit establish a first acoustical path that is non-radial relative to the central axis; and a second phasing plug including:

a second base portion including a second input side axially spaced from the second diaphragm to form a second compression chamber, a second output side facing the first output side, a plurality of second entrances on the second input side communicating with the second compression chamber, a plurality of second exits on the second output side, and a plurality of second channels fluidly interconnecting the second entrances with the respective second exits, where each corresponding second entrance, second channel and second exit establish a second acoustical path that is non-radial relative to the central axis; and a hub portion extending along the central axis from the second output side through the central bore, the hub portion including an outside surface having a diameter coaxial with the central axis, where the first exits and the second exits communicate with an annular region between the central bore and the outside surface.

23. The dual compression driver of claim 22, where the outside surface is bullet-shaped and terminates at an apex on the central axis.

24. The dual compression driver of claim 22, where the first phasing plug includes a conduit extending from the central bore along the central axis away from the first input side, the hub portion extends through the conduit, and the conduit and the outside surface form a waveguide extending from the annular region away from the first input side.

25. The dual compression driver of claim 24, including a sound radiator fluidly communicating with the waveguide.

26. The dual compression driver of claim 22, including a sound radiator fluidly communicating with the annular region.

27. The dual compression driver of claim 22, where the first diaphragm includes a first raised portion and the first base portion includes a first annular region shaped complementarily with the first raised portion, and the second diaphragm includes a second raised portion and the second base portion includes a second annular region shaped complementarily with the second raised portion.

28. The dual compression driver of claim 22, where the first output side abuts the second output side, and each first exit adjoins a respective second exit forming a common exit at the annular region.

29. The dual compression driver of claim 22, where the first exits and the second exits are concentric with the central axis.

30. The dual compression driver of claim 22, where the first entrances are arranged in a first pattern in a plane orthogonal to the longitudinal axis, the second entrances are arranged in a second pattern in a parallel plane, and the first pattern matches the second pattern.

31. The dual compression driver of claim 22, where each first entrance and each second entrance is arranged along a respective line that is diagonal relative to the central axis.

32. The dual compression driver of claim 22, where each first entrance has a cross-sectional area non-parallel to a cross-sectional area of the respective first exit, and each second entrance has a cross-sectional area non-parallel to a cross-sectional area of the respective second exit.

33. The dual compression driver of claim 22, where each first entrance has a cross-sectional area non-parallel to a cross-sectional area of the respective first channel, and each second entrance has a cross-sectional area non-parallel to a cross-sectional area of the respective second channel.

34. The dual compression driver of claim 22, where at least one first channel has a length different from respective lengths of the other first channels, and at least one second channel has a length different from respective lengths of the other second channels.

35. The dual compression driver of claim 22, where:

the plurality of first entrances lie along a plurality of lines, and the lines collectively form a first polygon including at least four vertices at which neighboring lines adjoin; and the plurality of second entrances lie along a plurality of lines, and the lines collectively form a second polygon including at least four vertices at which neighboring lines adjoin.

36. The dual compression driver of claim 35, where:

the plurality of first entrances is grouped into a plurality of sets of at least two first entrances and, for each set, the at least two first entrances lie along the same line; and the plurality of second entrances is grouped into a plurality of sets of at least two second entrances and, for each set, the at least two second entrances lie along the same line.

37. The dual compression driver of claim 35, where:

the plurality of first entrances is grouped into a plurality of sets of at least four first entrances and, for each set, the at least four first entrances lie along the same line; and the plurality of second entrances is grouped into a plurality of sets of at least four second entrances and, for each set, the at least four second entrances lie along the same line.

38. The dual compression driver of claim 35, where at least one of the first polygon and the second polygon is a quadrangle.

39. The dual compression driver of claim 35, where at least one of the first polygon and the second polygon is a star.

40. The dual compression driver of claim 22, including a dividing plate between the first base portion and the second base portion, the dividing plate including a central aperture through which the hub portion extends, where a first side of the dividing plate closes the first channels and a second side of the dividing plate closes the second channels.

41. The dual compression driver of claim 40, where the central aperture has a diameter different from a diameter of the central bore.

42. The dual compression driver of claim 40, where the first channels are arranged in a first pattern in a plane orthogonal to the longitudinal axis, the second channels are arranged in a second pattern in a parallel plane, and the first pattern is different from the second pattern.

43. A phasing plug, comprising:

a base portion including an input side, an output side, a plurality of entrances on the input side, a plurality of exits on the output side arranged about a central axis, and a plurality of channels fluidly interconnecting the entrances with the respective exits, where each corresponding entrance, channel and exit establish an acoustical path from the input side to the output side that is non-radial relative to the central axis, and the entrances lie along a plurality of lines collectively forming a polygon that includes greater than four vertices at which neighboring lines adjoin.

44. The phasing plug of claim 43, where the base portion includes a central bore coaxial with the central axis and extending from the input side to the output side, and the exits communicate with the central bore on the output side.

45. The phasing plug of claim 44, including a conduit extending from the central bore along the central axis away from the input side.

46. The phasing plug of claim 43, including a hub portion extending along the central axis from the output side through the central bore, the hub portion including an outside surface having a diameter coaxial with the central axis.

47. The phasing plug of claim 46, where the outside surface is bullet-shaped and terminates at an apex on the central axis.

48. The phasing plug of claim 43, where the base portion includes an annular region including a raised profile, and the entrances are located in the annular region.

49. The phasing plug of claim 43, where the exits are concentric with the central axis.

50. The phasing plug of claim 43, where each entrance is arranged along a respective line that is diagonal relative to the central axis.

51. The phasing plug of claim 43, where each entrance has a cross-sectional area non-parallel to a cross-sectional area of the respective exit.

52. The phasing plug of claim 43, where each entrance has a cross-sectional area non-parallel to a cross-sectional area of the respective channel.

53. The phasing plug of claim 43, where at least one channel has a length different from respective lengths of the other channels.

54. The phasing plug of claim 43, where the plurality of entrances is grouped into a plurality of sets of at least two entrances and, for each set, the at least two entrances lie along the same line.

55. The phasing plug of claim 43, where the polygon is a star.

* * * * *